US007621632B2

(12) United States Patent
Imoto et al.

(10) Patent No.: US 7,621,632 B2
(45) Date of Patent: Nov. 24, 2009

(54) IMAGE FORMING APPARATUS

(75) Inventors: Shinji Imoto, Tokyo (JP); Seiichi Kogure, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 28 days.

(21) Appl. No.: 10/563,214

(22) PCT Filed: May 2, 2005

(86) PCT No.: PCT/JP2005/008651

§ 371 (c)(1),
(2), (4) Date: May 5, 2006

(87) PCT Pub. No.: WO2005/108099

PCT Pub. Date: Nov. 17, 2005

(65) Prior Publication Data

US 2007/0103532 A1 May 10, 2007

(30) Foreign Application Priority Data

May 6, 2004 (JP) ..... 2004-137036
Jan. 4, 2005 (JP) ..... 2005-000057

(51) Int. Cl.
*B41J 2/01* (2006.01)

(52) U.S. Cl. ..... 347/104; 271/193; 347/36; 347/55; 399/44; 399/66; 399/303

(58) Field of Classification Search ..... 347/16, 347/101, 104, 105, 5, 14
See application file for complete search history.

(56) References Cited

U.S. PATENT DOCUMENTS 5,121,170 A * 6/1992 Bannai et al. ..... 399/303
5,276,483 A * 1/1994 Hasegawa et al. ..... 399/44
6,347,200 B1 * 2/2002 Shigeta et al. ..... 399/66
2002/0126193 A1 * 9/2002 Maki et al. ..... 347/104
2003/0052955 A1 3/2003 Kanome
2004/0160475 A1 * 8/2004 Satoh et al. ..... 347/36
2005/0128275 A1 * 6/2005 Uji et al. ..... 347/104
2006/0050124 A1 * 3/2006 Adachi ..... 347/104
2007/0120936 A1 * 5/2007 Kawabata ..... 347/104

FOREIGN PATENT DOCUMENTS

| | | |
|---|---|---|
| JP | 4-201469 | 7/1992 |
| JP | 9-254460 | 9/1997 |
| JP | 2001-31278 | 2/2001 |
| JP | 3224528 | 8/2001 |

(Continued)

*Primary Examiner*—Matthew Luu
*Assistant Examiner*—John P Zimmermann
(74) *Attorney, Agent, or Firm*—Cooper & Dunham, LLP

(57) ABSTRACT

An image forming apparatus can improve an accuracy of conveyance of a recording medium with a simple structure and prevent a reverse flow of mist so as to stably form a high-quality image. A conveyance belt (21) conveys a recording medium (12) by attracting the recording medium by an electrostatic force generated by electric charges applied thereto. A recording head (7) discharges droplets of a recording liquid toward the recording medium (12). An amount of electric charges induced on a surface of the recording medium (12), which has been conveyed to a recording position where the droplets of the recording liquid are discharged from the recording head (7) toward the recording medium (12), is adjusted in accordance with a resistance value of the recording medium (12).

16 Claims, 33 Drawing Sheets

FOREIGN PATENT DOCUMENTS

| | | | |
|---|---|---|---|
| JP | 2002-46310 | | 2/2002 |
| JP | 2003-103857 | | 4/2003 |
| JP | 2003-160253 | | 6/2003 |
| JP | 2004-99280 | | 4/2004 |
| JP | 2004099280 | * | 4/2004 |

* cited by examiner

IMAGE FORMING APPARATUS

TECHNICAL FIELD

The present invention relates to image forming apparatuses and, more particularly, to an image forming apparatus provided with a conveyance belt for conveying a recording medium.

BACKGROUND ART

There is known, for example, an inkjet recording apparatus as an image forming apparatus such as a printer, a facsimile or a copy machine apparatus. An inkjet recording apparatus performs recording by discharging ink droplets from a recording head onto a recording medium such as a recording paper (hereinafter, simply referred to as a "paper" but material is not limited to a paper). The inkjet recording apparatus is capable of recording a fine image at a high speed with advantages such as a low running cost, a low noise and an easy color image recording using multi-color ink.

In such an inkjet recording apparatus, it is required to increase a positional accuracy of landing positions of ink droplets on a paper so as to improve an image quality. There is known, such as disclosed in Japanese Laid-Open Patent Applications No. 4-201469, No. 9-254460 and No. 2000-25249, an inkjet recording apparatus that uniformly charges a conveyance belt to attract a paper by an electrostatic force to maintain a distance between a recording head and the paper constant, and to prevent an offset in a position of the paper by accurately controlling a paper feed, and to prevent a lift of the paper so as to prevent jamming and contamination of the paper due to a contact between the paper and the recording head.

However, it is known that when a conveyance belt is uniformly charged at a positive voltage to attract a paper by an electrostatic attraction force, ink droplets injected from a recording head are influenced by an electric field such that a trajectory of ink droplets is deflected, which causes offsets in landing positions of the ink droplets on the paper and a reverse flow of ink mist toward the recording head. In order to prevent offsets in landing positions of ink droplets and reverse flow of ink mist, there is known a charging method such as disclosed in Japanese Laid-Open Patent Application No. 2000-25249, in which ink droplets being injected is prevented from being influenced by an electric field by weakening a potential of a surface of a paper by applying an electric charge having a polarity opposite to a charge of a conveyance belt, of which surface is uniformly charged, on an upstream side of a recording head in the conveyance direction. Additionally, the paper is cause to be attracted by the conveyance belt by an electrostatic attraction force by weakening a potential of the surface of the paper having the same polarity as the surface of the conveyance belt.

Further, as a charging method of a conveyance belt, there is known a method such as disclosed in Japanese laid-Open Patent Application No. 2003-103857, in which an alternating charge pattern is formed on the surface of the conveyance belt by applying positive and negative charges alternately onto the surface of the conveyance belt by causing a voltage applying means being brought in contact with the surface of the conveyance belt.

By the way, in order to accurately negate the surface potential of a recording medium as is disclosed in Japanese Laid-Open Patent Application No. 2000-25249, it is necessary to adjust an amount of electric charges applied to a recording medium in accordance with the surface potential preferably at multiple levels since the surface potential of a recording medium changes with a material the recording medium and an environment of use of an image forming apparatus.

Means such as a sensor can be provided for accurately measuring a surface potential or a surface resistance of a recording medium, but such means causes the apparatus to become more complex and causes a problem of an increase in the cost and power consumption.

SUMMARY

In an aspect of this disclosure, there is provided an image forming apparatus that can improve an accuracy or conveyance of a recording medium with a simple structure and prevent a reverse flow of mist so as to stably form a high-quality image.

In another aspect of this disclosure, there is provided an image forming apparatus comprising: a conveyance belt that conveys a recording medium by attracting the recording medium by an electrostatic force generated by electric charges applied thereto; a charger that applies electric charges to the conveyance belt; a recording head that discharges droplets of a recording liquid toward the recording medium being conveyed by the conveyance belt; and adjusting means for adjusting an amount of electric charges induced on a surface of the recording medium, wherein the adjusting means adjusts the amount of the electric charges on the surface of the recording medium, which has been conveyed to a recording position where the droplets of the recording liquid are discharged from the recording head toward the recording medium, in accordance with a resistance value of the recording medium.

In the above-mentioned image forming apparatus, since there is provided the adjusting means, which adjusts the amount of the electric charges on the surface of the recording medium, which has been conveyed to a recording position where the droplets of the recording liquid are discharged from the recording head toward the recording medium, in accordance with a resistance value of the recording medium, an accuracy of conveyance of the recording medium is improved, and a flight direction of the droplets of the recording liquid discharged from the recording head is prevented from being deflected due to an influence of the electric field generated by the electric charges on the recording medium and mist of the recording liquid is prevented from adhering to the recording head due to reverse flow of the mist, thereby enabling stably formation of a high-quality image.

In the above-mentioned image forming apparatus, the adjusting means may adjust the amount of the electric charges on the surface of the recording medium in accordance with a result of detection of a surface resistance of the recording medium. The adjusting means may adjust the amount of the electric charges on the surface of the recording medium in accordance with a result of detection of a volume resistance of the recording medium. The adjusting means may adjust the amount of the electric charges on the surface of the recording medium in accordance with a result of detection of environment temperature and humidity. The adjusting means may adjust the amount of the electric charges on the surface of the recording medium in accordance with externally given information regarding the resistance value of the recording medium.

Additionally, there is provided, according to another aspect of this disclosure, an image forming apparatus comprising: a conveyance belt that conveys a recording medium by attracting the recording medium by an electrostatic force generated by electric charges applied thereto; a charger that applies electric charges to the conveyance belt; a recording head that discharges droplets of a recording liquid toward the recording medium being conveyed by the conveyance belt; and adjusting means for adjusting an amount of electric charges induced on a surface of the recording medium, wherein the adjusting means adjusts the amount of the electric charges on the surface of the recoding medium in accordance with a result of detection of a relative position between the recording medium and the charges applied to the conveyance belt.

In the above-mentioned image forming apparatus, since there is provided the adjusting means, which adjusts the amount of the electric charges on the surface of the recoding medium in accordance with a result of detection of a relative position between the recording medium and the charges applied to the conveyance belt, an accuracy of conveyance of the recording medium is improved, and a flight direction of the droplets of the recording liquid discharged from the recording head is prevented from being deflected due to an influence of the electric field generated by the electric charges on the recording medium and mist of the recording liquid is prevented from adhering to the recording head due to reverse flow of the mist, thereby enabling stably formation of a high-quality image.

Further, there is provided, according to another aspect of this disclosure, an image forming apparatus comprising: a conveyance belt that conveys a recording medium by attracting the recording medium by an electrostatic force generated by electric charges applied thereto; a charger that applies electric charges to the conveyance belt; a recording head that discharges droplets of a recording liquid toward the recording medium being conveyed by the conveyance belt; and adjusting means for adjusting an amount of electric charges induced on a surface of the recording medium, wherein the adjusting means adjusts the amount of the electric charges on the surface of the recording medium in accordance with a size of the droplets of the recording liquid discharged from the recording head.

In the above-mentioned image forming apparatus, since there is provided the adjusting means, which adjusts the amount of the electric charges on the surface of the recording medium in accordance with a size of the droplets of the recording liquid discharged from the recording head, an accuracy of conveyance of the recording medium is improved, and a flight direction of the droplets of the recording liquid discharged from the recording head is prevented from being deflected due to an influence of the electric field generated by the electric charges on the recording medium and mist of the recording liquid is prevented from adhering to the recording head due to reverse flow of the mist, thereby enabling stably formation of a high-quality image.

In the above-mentioned image forming apparatus, the adjusting means may adjust the amount of the electric charges on the surface of the recording medium in accordance with externally given information recording a size of the droplets of the recording liquid.

Additionally, there is provided, according to another aspect of this disclosure, an image forming apparatus comprising: a conveyance belt that conveys a recording medium by attracting the recording medium by an electrostatic force generated by electric charges applied thereto; a charger that applies electric charges to the conveyance belt; a recording head that discharges droplets of a recording liquid toward the recording medium being conveyed by the conveyance belt; and adjusting means for adjusting an amount of electric charges induced on a surface of the recording medium, wherein the adjusting means adjusts the amount of the electric charges on the surface of the recording medium in accordance with a viscosity of the droplets of the recording liquid discharged from the recording head.

In the above-mentioned image forming apparatus, since there is provided the adjusting means, which adjusts the amount of the electric charges on the surface of the recording medium in accordance with a viscosity of the droplets of the recording liquid discharged from the recording head, an accuracy of conveyance of the recording medium is improved, and a flight direction of the droplets of the recording liquid discharged from the recording head is prevented from being deflected due to an influence of the electric field generated by the electric charges on the recording medium and mist of the recording liquid is prevented from adhering to the recording head due to reverse flow of the mist, thereby enabling stably formation of a high-quality image.

In the above-mentioned image forming apparatus, the adjusting means may adjust the amount of the electric charges on the surface of the recording medium in accordance with a result of detection of an environment temperature.

Additionally, there is provided, according to another aspect of this disclosure, an image forming apparatus comprising: a conveyance belt that conveys a recording medium by attracting the recording medium by an electrostatic force generated by electric charges applied thereto; a charger that applies electric charges to the conveyance belt; a recording head that discharges droplets of a recording liquid toward the recording medium being conveyed by the conveyance belt; and adjusting means for adjusting an amount of electric charges induced on a surface of the recording medium, wherein the adjusting means adjusts the amount of the electric charges on the surface of the recording medium in accordance with at least two items including a resistance value of the recording medium, a result of detection of a relative position between the recording medium and the charges applied to the conveyance belt, a size of the droplets of the recording liquid discharged from the recording head and a viscosity of the droplets of the recording liquid discharged from the recording head.

In the above-mentioned image forming apparatus, since there is provided the adjusting means, which adjusts the amount of the electric charges on the surface of the recording medium in accordance with at least two items including a resistance value of the recording medium, a result of detection of a relative position between the recording medium and the charges applied to the conveyance belt, a size of the droplets of the recording liquid discharged from the recording head and a viscosity of the droplets of the recording liquid discharged from the recording head, an accuracy of conveyance of the recording medium is improved, and a flight direction of the droplets of the recording liquid discharged from the recording head is prevented from being deflected due to an influence of the electric field generated by the electric charges on the recording medium and mist of the recording liquid is prevented from adhering to the recording head due to reverse flow of the mist, thereby enabling stably formation of a high-quality image.

Further, there is provided, according to another aspect of this disclosure, an image forming apparatus configured and arranged to perform both-side printing, comprising: a conveyance belt that conveys a recording medium having a first surface and a second surface opposite to the first surface by attracting the recording medium by an electrostatic force generated by electric charges applied thereto; a charger that applies electric charges to the conveyance belt; a recording head that discharges droplets of a recording liquid toward the recording medium being conveyed by the conveyance belt; and adjusting means for adjusting an amount of electric charges induced on a surface of the recording medium, wherein the adjusting means adjusts the amount of the electric charges on the surface of the recording medium, which has been conveyed to a recording position where the droplets of the recording liquid are discharged from the recording head toward the recording medium, in accordance with a resistance value of the recording medium and a fact as to whether an image is being formed on the first surface to be printed first or the second surface printed subsequent to the first surface.

In the above-mentioned image forming apparatus, since there is provided the adjusting means, which adjusts the amount of the electric charges on the surface of the recording medium, which has been conveyed to a recording position where the droplets of the recording liquid arc discharged from the recording head toward the recording medium, in accordance with a resistance value of the recording medium and a fact as to whether an image is being formed on the first surface to be printed first or the second surface printed subsequent to the first surface, in both-side printing, an accuracy of conveyance of the recording medium is improved, and a flight direction of the droplets of the recording liquid discharged from the recording head is prevented from being deflected due to an influence of the electric field generated by the electric charges on the recording medium and mist of the recording liquid is prevented from adhering to the recording head due to reverse flow of the mist, thereby enabling stably formation of a high-quality image.

In the above-mentioned image forming apparatus, a resistance value of the second surface of the recording medium may be presumed in accordance with an amount of the recording liquid adhered onto the first surface of the recording medium. A resistance value of each predetermined area of the second surface of the recording medium may be presumed in accordance with an amount of the recording liquid adhered on each predetermined area of the first surface or the recording medium.

In each of the above-mentioned image forming apparatuses, the adjusting means may adjust the amount of the electric charges on the surface of the recording medium by controlling a charge period length of positive and negative charges applied by the charger to the conveyance belt. The adjusting means may adjust the amount of the electric charges on the surface of the recording medium by controlling an alternating voltage applied to the charger to apply positive and negative charges to the conveyance belt. The adjusting means may adjust the amount of the electric charges on the surface of the recording medium by controlling a timing of applying electric charges onto the conveyance belt so as to switch existence/nonexistence of charges on the surface of the recording medium. The adjusting means may adjust the amount of the electric charges on the surface of the recording medium by controlling at least one of a conveyance speed and a stop time of the conveyance belt so as to change a time period from a time when the charges are applied to the conveyance belt until a time when the charges on the conveyance belt reach the recording position.

Other aspects, features and advantages will become more apparent from the following detailed description when read in conjunction with the accompanying drawings.

BEST MODE FOR CARRYING OUT THE INVENTION

Figure 1:
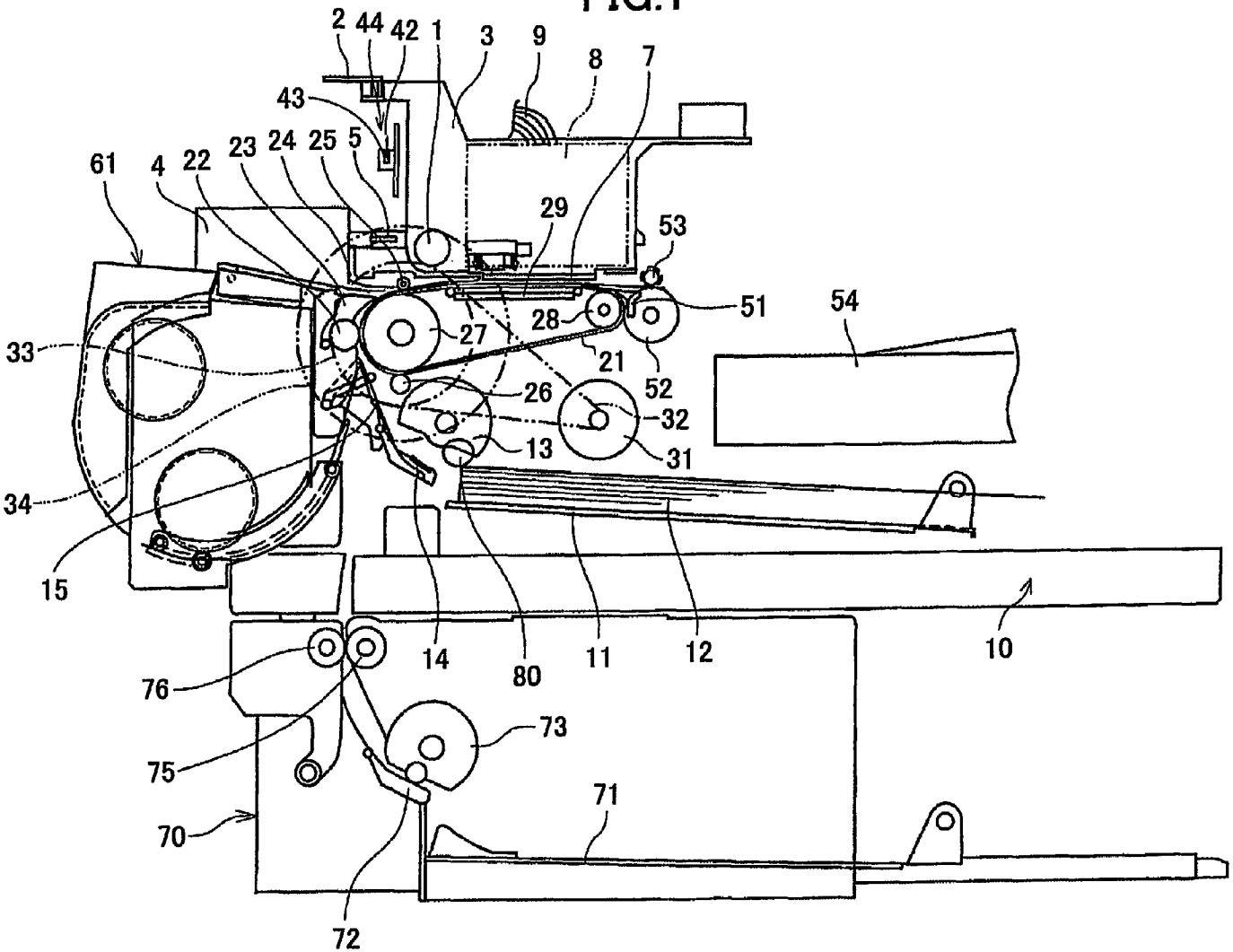
FIG. 1 is an illustrative side view of an image forming apparatus according to a first embodiment of the present invention.
Figure 2:
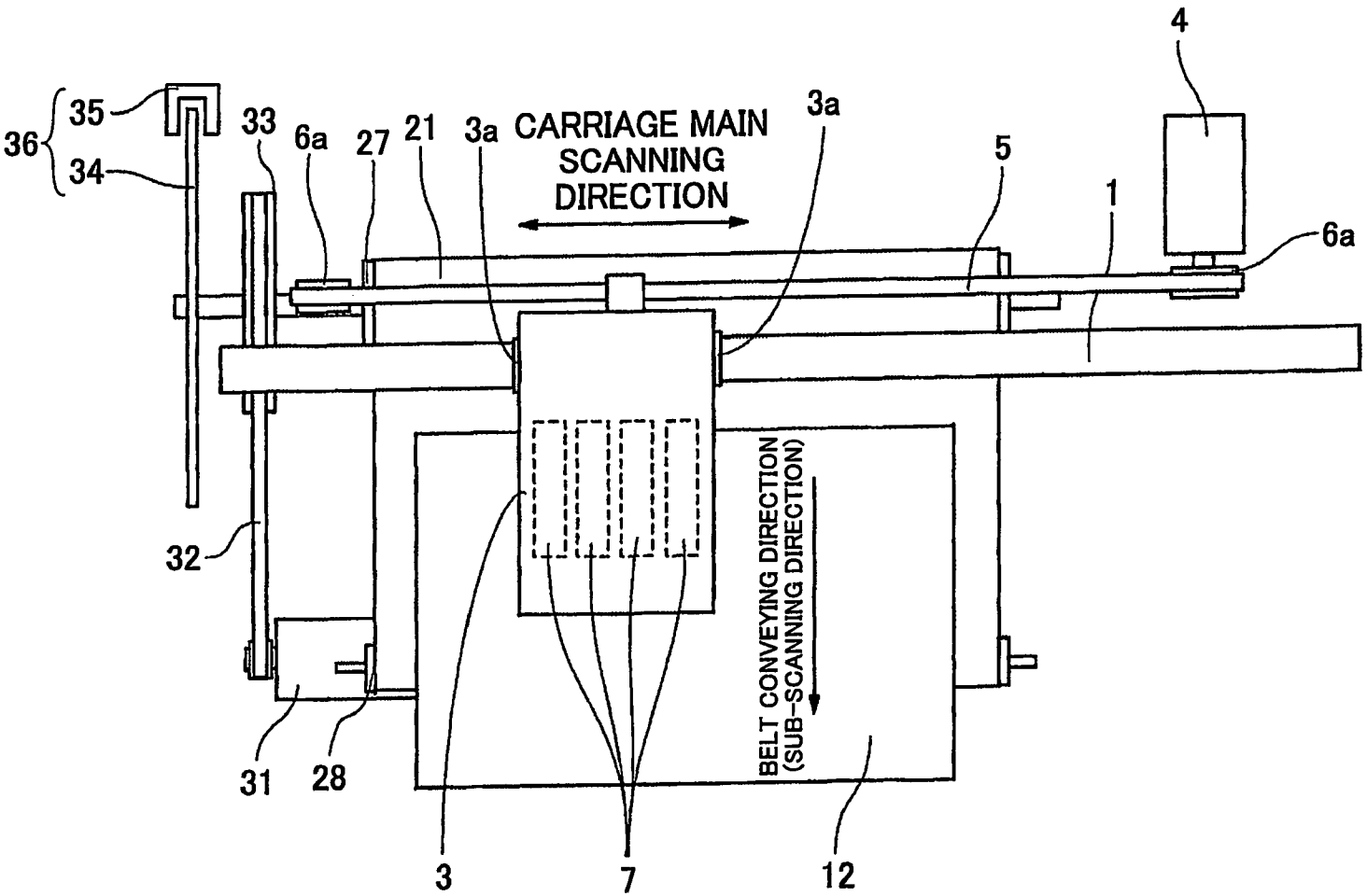
FIG. 2 is a plan view of a part of the image forming apparatus shown in FIG. 1.

A description will now be given, with reference to the accompanying drawings, of embodiments according to the present invention. First, a description will be given, with reference to FIGS. 1 and 2, of an image forming apparatus according to a first embodiment of the present invention. FIG. 1 is an illustrative side view of the image forming apparatus. FIG. 2 is a plan view of a part of the image forming apparatus shown in FIG. 1.

In the image forming apparatus shown in FIG. 1, a carriage 3 is slidably supported by a guide rod 1 and a guide rail 2 that bridge between left and right side plates (not shown in the figure) in a main scanning direction so that the carriage 3 is moved to scan in directions of arrows (the main scanning direction) in FIG. 2 by a main scanning motor via a timing belt being engaged with a drive pulley 6*a* and an idle pulley 6*b*. It should be noted that guide bushings (bearings) 3*a* are interposed between the carriage 3 and the guide rod 1, respectively.

Four recording heads 7 which consist of liquid droplet discharge heads, which discharge ink droplets of yellow (Y), cyan (C), magenta (M) and black (Bk), are arranged so that a plurality of ink discharge ports are arranged in a direction perpendicular to the main scanning direction and ink droplet discharge direction is directed downward.

The inkjet head constituting the recording head 7 may be of a piezoelectric actuator type using a piezoelectric element, a thermal actuator type using a phase change caused by film boiling of a liquid by an electrothermal transforming element, a shape memory alloy actuator type using metal phase change caused by a temperature change, an electrostatic actuator type using an electrostatic force, etc. It should be noted that the recording head may be constituted by one or more liquid discharge heads each having a plurality of nozzle trains discharging different color ink.

Sub-tanks 8 for each color are mounted on the carriage 3 so as to supply ink of each color to the recording head 7. Ink is supplied to each of the sub-tanks 8 from a main-tank (ink cartridge) through ink supply tubes 9. It should be noted that a recording head which discharges a fixing process liquid (fixing ink) for improving fixation of ink by reacting with the recording liquid (ink) may be provided other than the recording head 7 for discharging ink droplets.

AS a paper supply part for supplying the recording papers 12 stacked on a paper placement part (press plate) 11 of a paper supply cassette 10, a semilunar roller (paper supply roller) and a separation pad 14 are provided in the apparatus. The semilunar roller 13 separates and feeds the recording papers 12 one by one from the paper placement part 11. The separation pad 14 is made of a material having a large coefficient of friction and is urged toward the paper supply roller 13.

Additionally, there is provided, as a conveyance part for conveying the recording papers 12 fed from the paper feed part under the recording head 7, a conveyance belt 21, a counter roller 22, a conveyance guide 23 and an end press roller 25. The conveyance belt 21 conveys the recording papers 12 by attaching thereto by an electrostatic force. The counter roller 22 conveys each recording paper 12, which is fed from the paper feed part through a guide 15, by sandwiching each recording paper 12 with the conveyance belt 21. The guide 23 causes each recording paper 12 being fed upwardly to turn by about 90 degrees so that each recording paper 12 follows the conveyance belt 21. The end press roller 25 is urged toward the conveyance belt 21 by a press member 24. Additionally, a charge roller 26 is provided, which is charge means for electrically charging a surface of the conveyance belt so as to generate an electrostatic attraction force.

The conveyance belt 21 is an endless belt (originally formed as an endless belt or may be formed by connecting opposite ends of a belt), which is engaged with a conveyance roller 27 and a tension roller 28 so as to be rotated in a belt conveyance direction in FIG. 2 (sub-scanning direction) by the conveyance roller 21 being rotated by a sub-scanning motor 31 via a timing belt 32 and a timing roller 33. It should be noted that a guide member 29 is arranged in correspondence with an image forming area by the recording head on the reverse side of the conveyance belt 21.

Figure 3:
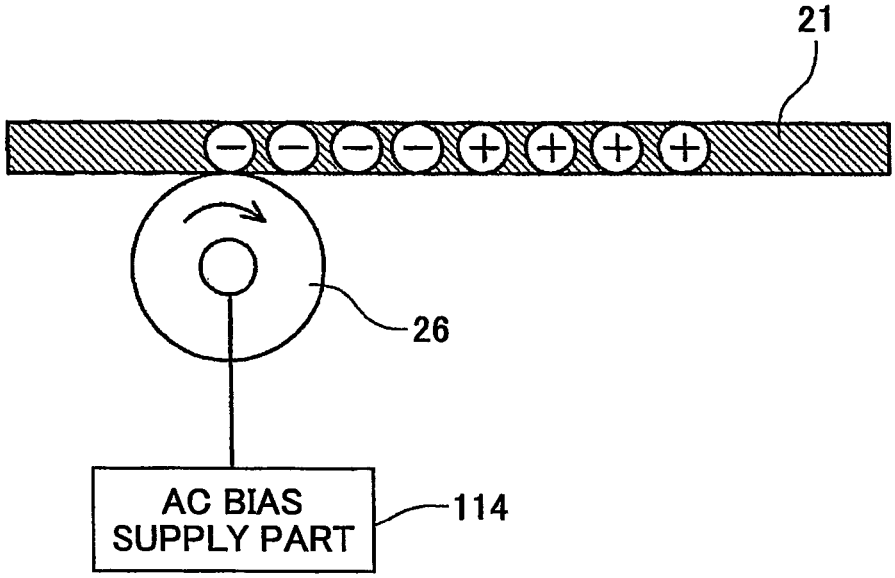
FIG. 3 is an illustration showing a layered structure of an example of a conveyance belt shown in FIG. 1.
Figure 4:
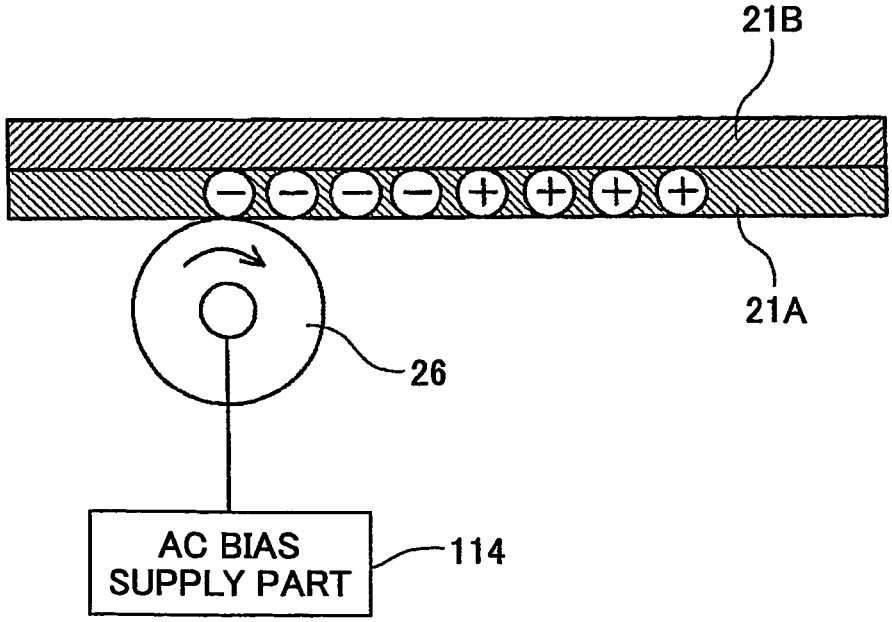
FIG. 4 is an illustration showing a layered structure of another example of the conveyance belt shown in FIG. 1.

As the conveyance belt 21, a belt of a single-layered structure may be used as shown in FIG. 3, or a belt having a multi-layered structure may be used as shown in FIG. 4. If the conveyance belt 21 of a single-layered structure is used, an entire layer is formed of an insulating material since the conveyance belt 21 is brought into contact with the recording paper 12 and the charge roller 28. Moreover, if the conveyance belt 21 of a multi-layered structure is used, it is preferable to form an insulating layer 21 on a side which is brought into contact with the recording paper 12 and the charge roller 26, and a conductive layer 21B on a side which is not brought into contact with the recording paper 12 and the charge roller 26.

As for the insulating material for forming the conveyance belt 21 having the single-layered structure and the insulating layer 21A of the conveyance belt 21 having the multi-layered structure, it is preferable to use a material such as a resin or an elastomer such as PET, PEI, PVDF, PC, ETFE or PTFE and does not contain a conductivity control material. Additionally, a volume resistivity of the material may be equal to or higher than $10^{12}$ Ωcm, preferably, be $10^{15}$ Ωcm. Moreover, as for a material to form the conductive layer 21B of the conveyance belt 21 having the multi-layered structure, it is preferable to set a volume resistivity from $10^5$ to $10^7$ Ωcm by mixing carbon into the above-mentioned resin or elastomer.

The charge roller 26 is brought into contact with the insulating layer 21A forming a front layer of the conveyance roller 21 (in a case of the multi-layered belt) and is rotated by the movement of the conveyance belt 21 so as to apply a pressing force to opposite ends of the shaft. The charge roller 26 is formed by a conductive member having a volume resistivity of $10^6$ to $10^9$Ω/□. For example, positive and negative AC bias (high voltage) of 2 kV is applied from an AC bias supply part (high-voltage power source) 114 to the charge roller 26 as mentioned later. Although the AC bias can be a sinusoidal wave or a triangular wave, a square wave is more preferable.

Moreover, as shown in FIG. 2, a slit disc 34 is attached to the shaft of the conveyance roller 27, and a sensor 35 is provided to detect slits of the slit disc 34 so that an encoder 36 is formed by the slit disc 34 and the sensor 35.

Moreover, an encoder scale 42 having slits is provided on the front side of the carriage 3, as shown in FIG. 1, and an encoder sensor 43 comprising a transmission type photo sensor is provided on the front side of the carriage 3 to detect the slits of the encoder scale 42 so that an encoder 44 is formed to detect a position of the carriage 3 in the main scanning direction.

Further, as a paper eject part for ejecting the recording paper 12 recorded by the recording head 7, there are provided a separation claw 51 for separating each recording paper 12 from the conveyance belt 21, paper eject rollers 52 and 53, and a paper eject tray 54 for accommodating the ejected recording paper 12.

Additionally, a double-side paper feed unit 61 is detachably attached to a backside of the inkjet recording apparatus. The double-side paper feed unit 61 takes each recording paper 12 returned by reverse rotation of the conveyance belt 21 and turns over the returned recording paper 12, and feeds the recording paper 12 to a position between the counter roller 22 and the conveyance belt 21.

Further, an expansion tray 70 can be attached to the bottom the image forming apparatus as shown in FIG. 1. The expansion tray 70 comprises, similar to the paper supply tray 10, a press plate (paper placement plate) 71 on which recording papers 12 are placed, a paper supply roller 73 and a separation pad 74. When supplying recording papers from the expansion tray 10, the recording papers are fed one by one by the paper supply roller 73 and the separation pad 74, and, then, the recording papers are fed by conveyance rollers 75 and 76 to a position between the counter roller 22 and the conveyance belt 21 from under the apparatus body.

Additionally, a surface resistance meter 80 is provided in at part by the paper supply roller 13 (in the main scanning direction) in the paper feed path of the recording paper 12 so as to measure a surface resistivity of the recording paper being fed.

In the image forming apparatus having the above-mentioned structure, each recording paper 12 is separated and fed from the paper supply part, each recording paper 12 being fed upwardly in a vertical direction is guided by the guide 15, each recording paper 12 is conveyed while being sandwiched between the conveyance belt 21 and the counter roller 22, and, then, the end of each recording paper 12 is guided by the conveyance guide 23 and pressed against the conveyance belt 21 by the end press roller 25 so as to change the direction of conveyance by about 90 degrees.

At this time, an alternating voltage is applied to the charge roller 26 from a high-voltage source so that a positive output and a negative output are repeatedly applied to the charge roller 26. Thus, the conveyance roller 21 is charged in an alternating charge voltage pattern so that plus and minus charges are alternately arranged in the sub-scanning direction, which is a rotational direction of the conveyance belt 21. When the recording paper 12 is fed onto the conveyance belt 21, which is charged in the alternating plus and minus pattern, the recording paper 12 is attracted by the conveyance belt 21 by an electrostatic force, and, thereby, the recording paper 12 is conveyed by the conveyance belt 21 rotating in the sub-scanning direction.

Thus, recording of one line is performed by ejecting ink droplets onto the recording paper 12, when the recording paper is stopped, by driving the recording head 7 in accordance with image signals while moving the carriage 3, and, then, recording of a next line is performed after conveying the recording paper by a predetermined distance. Upon receipt of a recording end signal or a signal which indicates that a trailing edge of the recording paper 12 reached the recording area, the recording operation is ended, and the recording paper 12 is ejected onto the paper eject tray 54.

In a case of double-side print, the conveyance belt 21 is reversed after completion of the recording of a front side (surface printed first) so as to send the recorded recording paper 12 to the double-side paper feed unit 61. Thereafter, the recording paper 12 is turned over (set the backside to be a surface to be printed) and is fed to a position between the counter roller 22 and the conveyance belt 21. Then, recording of the backside is performed by conveying the recording paper 12 to the conveyance belt 21 while performing a timing control, and, thereafter the recording paper 12 is ejected onto the paper eject tray 54.

Figure 5:
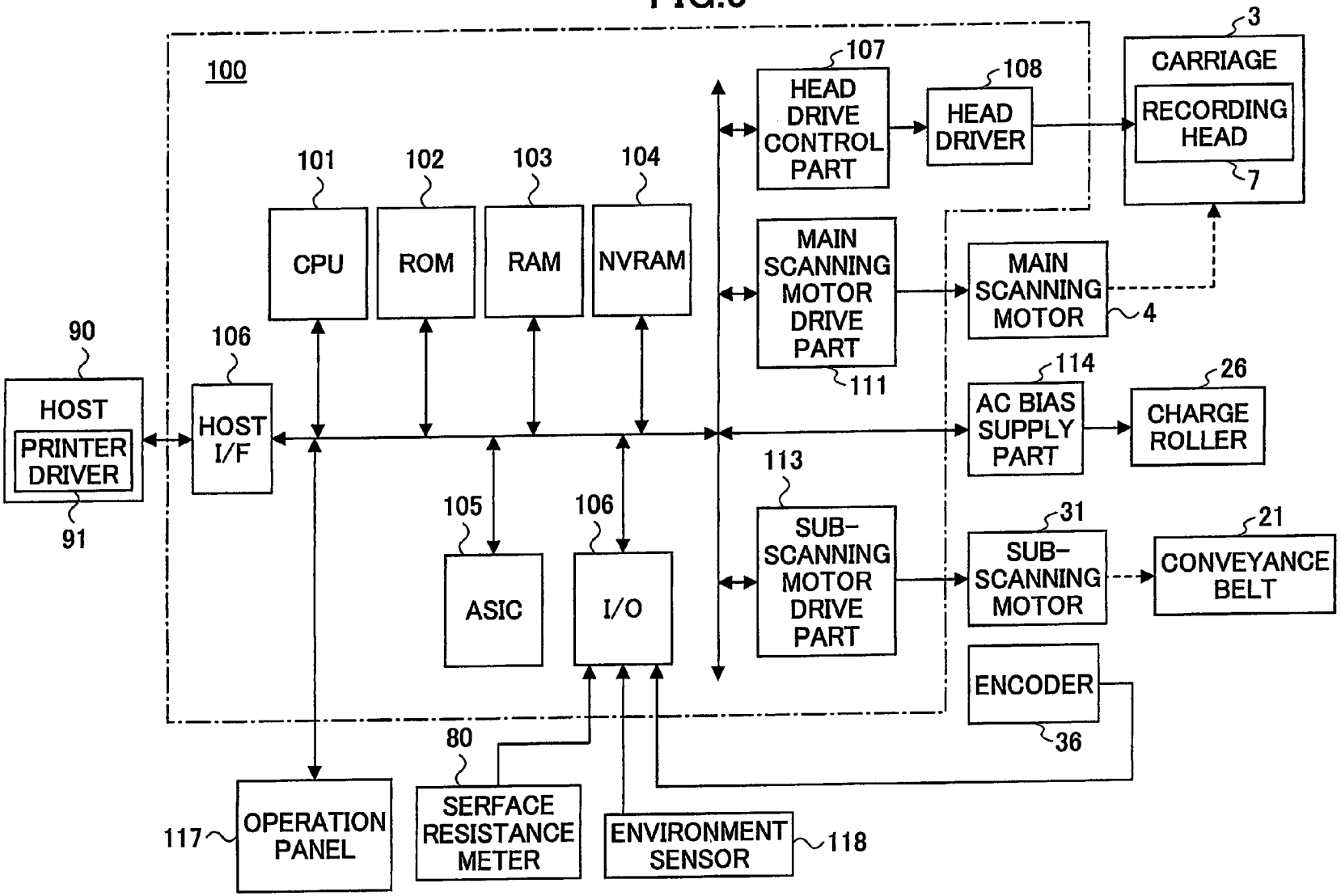
FIG. 5 is a block diagram of an entire control part of the inkjet recording apparatus shown in FIG. 1.

A description will now be given, with reference to FIG. 5, of a control part of the inkjet recording apparatus. FIG. 5 is a block diagram of the entire control part of the inkjet recording apparatus shown in FIG. 1.

The control part 100 comprises: a central processing unit (CPU) 101 which controls the entire apparatus; a read only memory (ROM) 102 for storing programs executed by the CPU 101 and other fixed data; a random access memory (RAM) 103 for temporarily storing image data; a rewritable non-volatile memory 104 for retaining data while the power of the apparatus is turned off; and an application specification integrated circuit (ASIC) 105 for performing image processing including various signal processing and rearrangement on the image data and input and output signal processing for controlling the entire apparatus.

Additionally, the control part 100 comprises: an interface (I/F) 106 for exchanging data and signals with a host side 90 which is a data processing apparatus such as a personal computer; a head drive control part 107 and a head driver 108 for controlling drive of the recording head 7; a main scanning motor drive part 111 for driving the main scanning motor 4; a sub-scanning motor drive part 113 for driving the sub-scanning motor 31; and an interface (I/O) 116 for inputting detection signals from an the encoder 34, the surface resistance meter 80 for detecting a surface resistance value of a recording medium, an environment sensor 118, which detects an environmental temperature and/or environmental humidity, the above-mentioned encoder 44 (not shown in the figure), and other various sensors.

The control part 100 is connected with an operation panel 117 for inputting and displaying information necessary for the apparatus. Additionally, the control part 100 performs on and off operations of an output of an AC bias supply part 114, which applies an AC bias to the charge roller 26.

The control part 100 receives print data from the host side by the I/F 106 through a cable or a net, the print data containing image data from a data processing apparatus such as a personal computer, an image reading apparatus such as an image scanner or an image taking apparatus such as a digital camera. It should be noted that creation of the print data supplied to the control part 100 is performed by a printer driver 91 of the host side 90.

The CPU 101 reads and analyzes the print data stored in a receiver buffer included in the I/F 106, and causes the ASIC 105 to rearrange the data and, then, transfers the image data to the head drive control part 107. It should be noted that although the image data is developed to bit map by the printer drive 91 and transferred to the apparatus, the conversion of the image data to the bit map data may be performed according to, for example, font data stored in the ROM 102.

The head drive control part 107 sends, after acquiring the image data (dot-pattern data) corresponding to one line of the recording head, the dot-pattern data as serial data corresponding to one line to the head driver 108 in synchronization with a clock signal, and also sends a latch signal to the head driver 108 at a predetermined timing.

The head drive control part 107 includes a ROM (may be constituted by the ROM 102) which stores pattern data of a drive waveform (drive signal) and a drive waveform generation circuit which has an amplifier and a waveform generation circuit including a D/A converter, which converts the drive waveform data read from the ROM.

The head driver 108 comprises: a shift register which inputs the clock signal and the serial data, which is serial data, sent from the head drive control part 107; a latch circuit which latches a register value of the shift register by a latch signal from the head drive control part 107; a level conversion circuit (level shifter) which carries out level change of the output value of the latch circuit; and an analog switch array (switch means) which is turned on and off by the level shifter. The head driver 108 selectively applies a desired drive waveform contained in the drive waveform to the recording head 7 by controlling on/off of the analog switch array so as to drive the recording head 7.

The main scanning motor drive part 111 computes a control value based on a target value given by the CPU 101 and a speed detection value acquired by sampling detection pulses from the encoder 44, and drives the main scanning motor 4 via an internal motor driver.

Similarly, the sub-scanning motor drive part 113 computes a control value based on a target value given by the CPU 101 and a speed detection value acquired by sampling detection pulses from the encoder 36, and drives the sub-scanning motor 31 via an internal motor driver.

Figure 6:
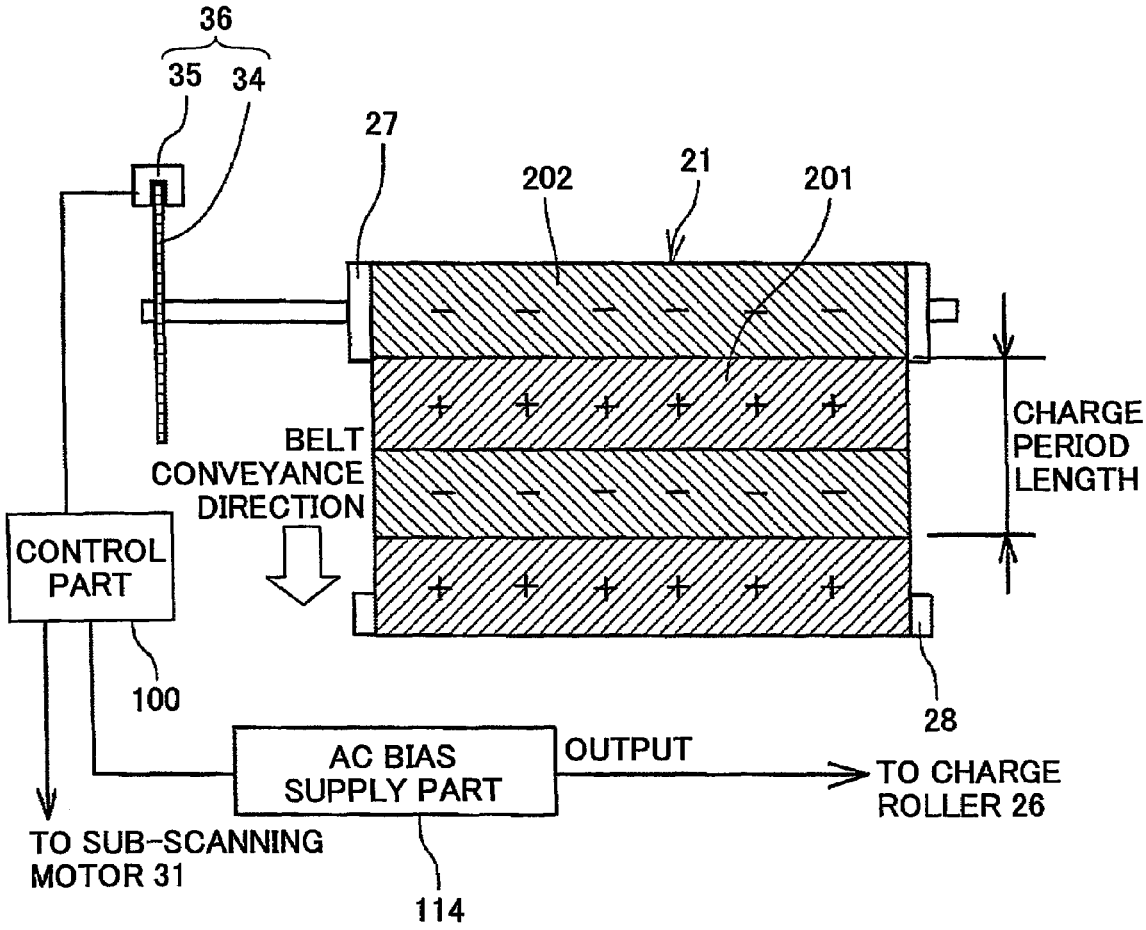
FIG. 6 is an illustration of a part relating to a charge control.
Figure 7:
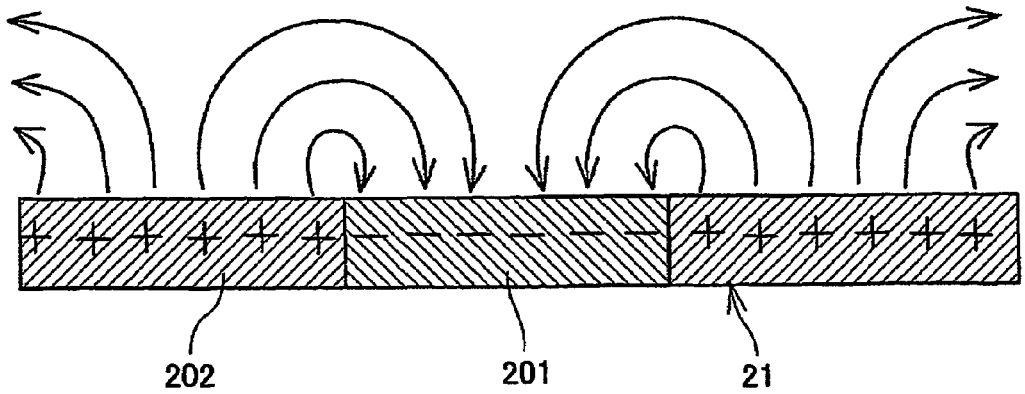
FIG. 7 is an illustration for explaining electric charges on a conveyance belt.
Figure 8:
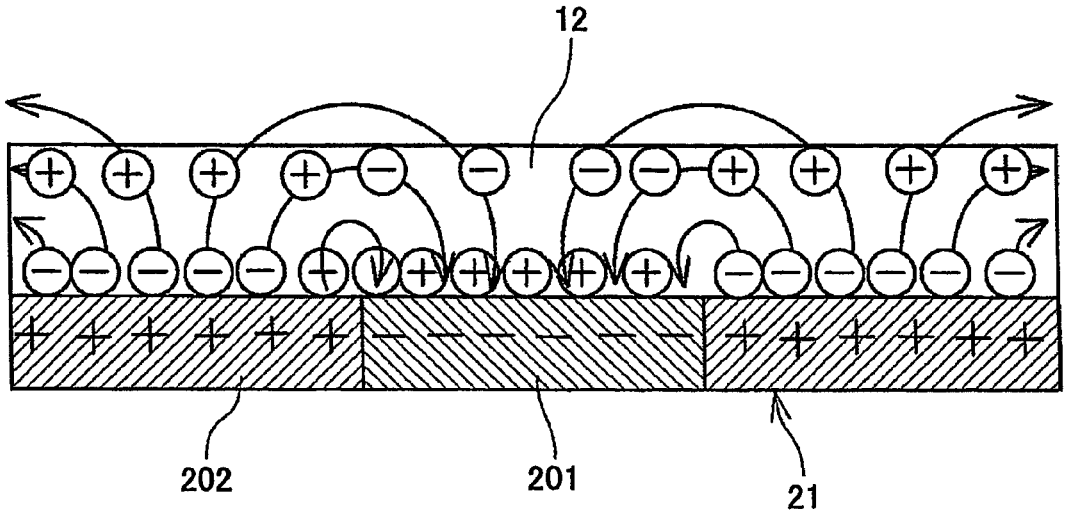
FIG. 8 is an illustration for explaining electric charges when a recording paper is brought into contact with the conveyance belt.

A description will be give, with reference to FIG. 6, of a part relating to a charge control to the conveyance belt 21 in the image forming apparatus. FIG. 6 is an illustration of the part relating to the charge control. As mentioned above, an amount of rotation is detected by the encoder 36 provided at the end of the conveyance roller 27 which drives the conveyance belt 21 so that the sub-scanning motor 31 is controlled by the control part and the above-mentioned sub-scanning motor drive part 113 and the output of the AC bias supply part 114, which applies a high-voltage (AC bias) to the charge roller 26 in accordance with the detected amount of rotation.

A period (apply time) of the positive and negative voltage applied to the charge roller 26 is controlled by the AC bias supply part 114, and, simultaneously, positive and negative electric charges are applied onto the conveyance belt 21 at a predetermined charge period length by the control part 100. Additionally, the control part 100 controls the AC bias supply part 114 to change the period of the applied voltage output from the AC bias supply part 114. That is in the present embodiment, the control part 100 serves as both control means for controlling the charge period of positive and negative electric charges applied to the conveyance belt 21 and control means for controlling a conveyance speed of the conveyance belt 21 in accordance with the charge period length of the positive and negative charges applied to the conveyance belt 21.

Here, as mentioned above, when starting printing, the conveyance belt 21 is rotated clockwise in FIG. 1 by driving the conveyance roller 27 by the sub-scanning motor 31, and, at the same time, a square wave is applied from the AC bias supply part 114 to the charge roller 26. Thus, since the charge roller 26 is in contact with the insulating layer 21A of the conveyance belt 21, the positive and negative charges are applied alternately in a belt-like pattern in the conveyance direction of the conveyance belt 21 onto the insulating layer 21A of the conveyance belt 21, as shown in FIG. 6, and uneven electric field is generated on the conveyance belt 21. It should be noted that the term "charge period length" means a length (width) of a pair of positive and negative charge patterns adjacent to each other as shown in the figure.

Since the insulating layer 21A of the conveyance belt 21 to which the positive and negative charges are applied is formed so that a volume resistivity thereof is equal to or higher than $10^{12}$ Ωcm, preferably, $10^{15}$ Ωcm as mentioned above, the positive and negative charges on the insulating layer 21A are prevented from moving at the boundary therebetween, which maintains the positive and negative charges on the insulating layer 21A.

On the other hand, an electric charge of, for example, 1 kV, is applied between two terminals of a surface resistance meter 80, which is provided by the paper supply roller 13 and can be brought into contact with the recording paper 12, and an electric current flowing between the terminals is measured so as to measure a surface resistance of the recording paper 12 before or during a paper feeding operation.

Then, when the recording paper 12 as a recording medium is separated by the paper supply roller 13 and the separation pad 14 and the recording paper 12 is fed to the conveyance belt 21 in which an uneven electric field is generated by the positive and negative charges formed on the insulating layer 21A, a polarization occurs instantaneously in the recording paper 12 in a direction of the electric field and the recording paper 12 is attracted by the conveyance belt 21. According to the uneven electric field, charges causing an attraction force between the conveyance belt 21 and the surface of the recording paper on the side of the conveyance belt becomes dense and the charges causing a repelling force between the conveyance belt becomes nondense. Due to the difference in charges, the recording paper 12 is instantaneously attached to the conveyance belt 21. Simultaneously, true electric charges are induced on the attracted surface of the recording paper 12 and the reverse surface thereof since the recording paper 12 has a limited resistance.

Although the charges induced at the attracted surface side of the recording paper 12 and the charges applied on the conveyance belt 21 are stable by being attracted by each other, the positive and negative true charges induced on the reverse side are unstable.

Since the recording paper 12 has a limited surface resistance value of $10^7\Omega/\square$-$10^{13}\Omega/\square$, the true electric charges induced on the surface opposite to the attraction surface for the recording paper 12 can be moved. Thus, the adjacent positive and negative electric charges are attracted and move to each other, thereby being neutralized and reduced with passage of time.

Consequently, the charges on the conveyance belt 21 are balanced with the true electric charges induced on the attraction surface of the recording paper 12, which results in cancellation of the electric field, and true electric charges induced on the opposite side of the attraction surface of the recording paper 12 are neutralized and the electric field is cancelled. That is, the electric field which extends toward the recording head 7 is decreased. Moreover, since the electric charges applied onto the conveyance belt 21 and the electric charges opposite to the electric charges on the conveyance belt 21 are reduced on the surface of the recording paper 12, the attraction force between the recording paper 12 and the conveyance belt 21 is increased with passage of time.

Figure 9:
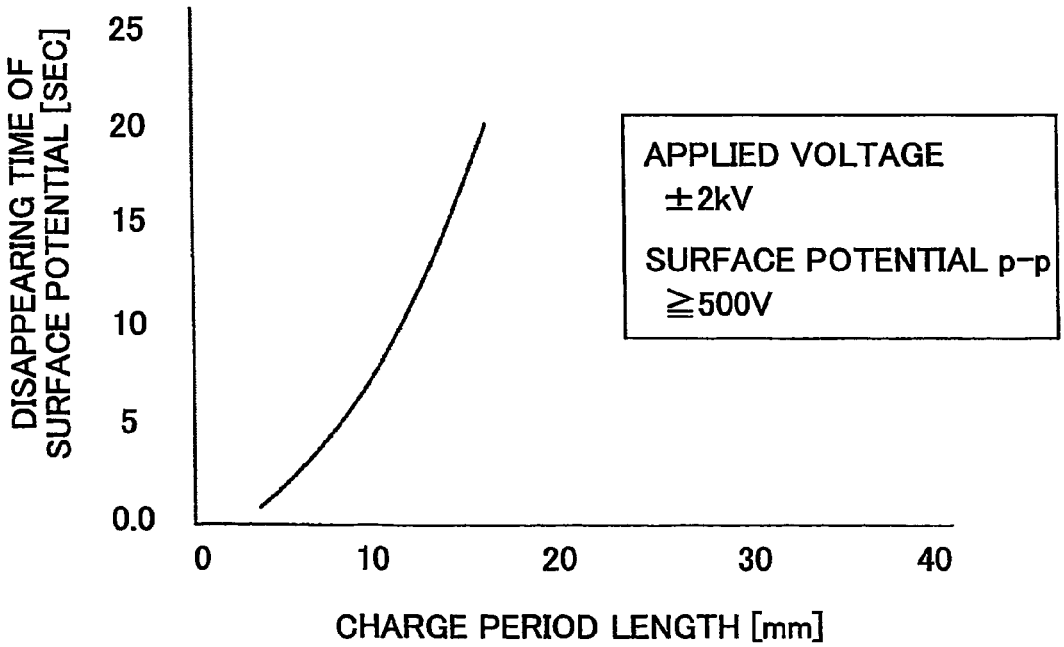
FIG. 9 is a graph showing a relationship between a disappearing time of a surface potential and a charge period length.

Here, as shown in FIG. 9, an amount of the decrease in the surface potential on the surface of the recording paper 12 and a time period until the charges disappears depend on the resistance of the recording paper and the charge period length. As the resistance of the recording paper 12 is increased, an amount of movement of the charges induced on the surface of the recording paper 12 (the surface opposite to the conveyance belt) is decreased. Thus, it takes a time for the charges on the surface to be neutralized. Moreover, since a distance between the positive and negative charges induced is increased as the charge period length is increased, the substantial resistance when the charges move is increased. Furthermore, since the potential acting between the positive and negative charges is also decreased in reverse proportion to the distance, it takes a time for the charges on the surface to be neutralized.

Therefore, if the resistance value of the paper 12 is the same and the amount of charge per unit area applied on the conveyance belt 21 is the same, the disappearing time of the charges on the surface of the recording paper (opposite to the conveyance belt) is in proportion to about a square of the charge period length.

The recording paper 12 attracted by the conveyance belt 21 is conveyed to a position under the recording head 7 as mentioned above. Then, the carriage 3 reciprocally moves in the main scanning direction and simultaneously ink droplets are discharged from the recording head 7, thereby an image corresponding to one reciprocation of the recording head 7 being formed on the recording paper 12. After the image corresponding to one reciprocation is formed, the recording paper 12 is conveyed by the conveyance belt to a next printing position, and an image corresponding to one reciprocation is formed again on the recording paper 12. After completion of the image, the recording paper 12 is conveyed by the conveyance belt 21, and is separated from the conveyance belt 21 by the separation claw 51, and, then, ejected onto the paper eject tray 54.

Figure 10:
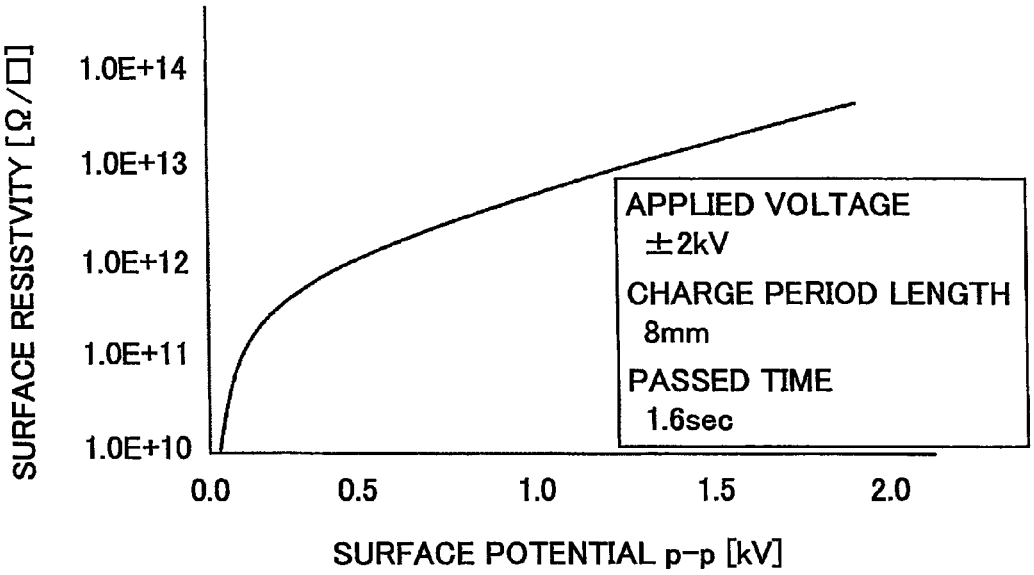
FIG. 10 is a graph showing a relationship between a surface resistivity and a surface potential.

Here, an example of a correlation between the paper surface potential acquired by experiments and a surface resistivity of the recording paper is shown in FIG. 10. In the experiments, the surface potential was measured by setting a condition where the charge period length is 8 mm, the application voltage is ±2.0 kV, and the time period passed from a time when the conveyance belt 21 is brought into contact with the recording paper 12 is 1.6 seconds. From the results of the experiments, is can be appreciated that the surface potential is increased as the surface resistivity is high.

Figure 11:
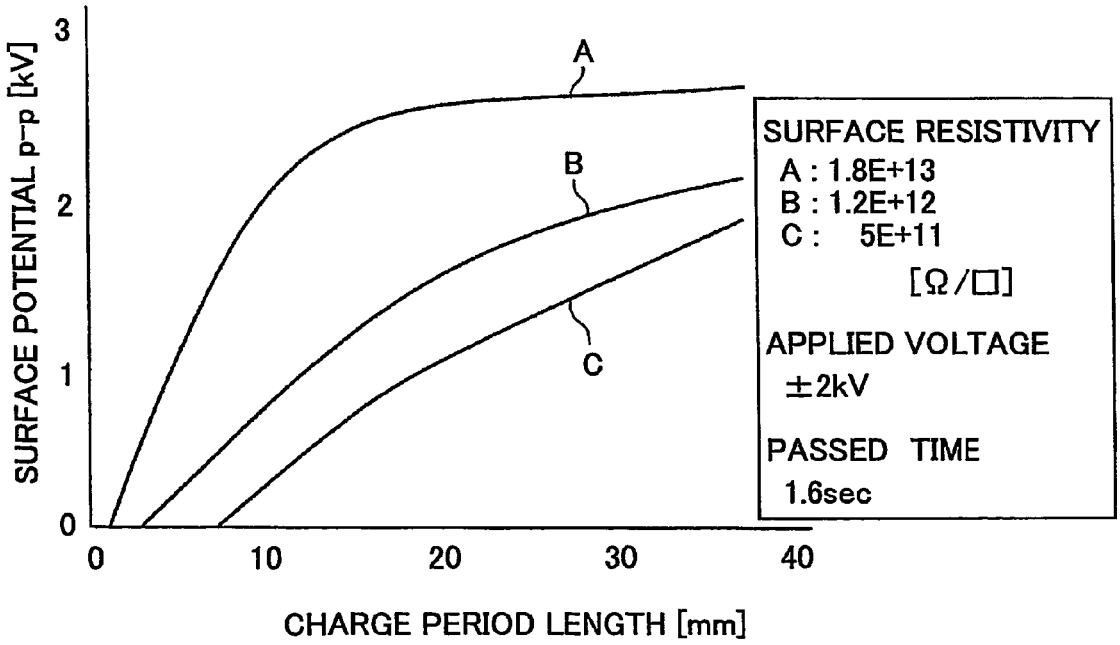
FIG. 11 is a graph showing a relationship between a surface potential and a charge period length with respect to three kinds of recording papers.

Additionally, FIG. 11 shows examples of relationships between the charge period length and the surface potential of the recording paper with respect to three kinds of recording paper having different surface resistivities obtained by experiments (recording paper A: $1.8\times10^{13}\Omega/\square$, recording paper B: $1.2\times10^{12}\Omega/\square$, recording paper C: $5\times10^{11}\Omega/\square$). In the experiments, the surface potential was measured by setting a condition where the application voltage is ±2.0 kV and the time period passed from a time when the conveyance belt 21 is brought into contact with the recording paper 12 is 1.6 seconds.

According to the results of the experiments, it is appreciated that the charge period length for which the surface potential disappears varies between the recording papers A, B and C having different resistivities after the predetermined time period has passed (after 1.6 seconds), and the surface potential of the recording paper can be decreased by decreasing the charge period length even if the surface resistivity of the recording paper is high. That is, the adjustment of an amount of charge on the surface of a recording medium conveyed to a recording position (image forming position) by the recording head can be performed by controlling the charge period length.

Figure 12:
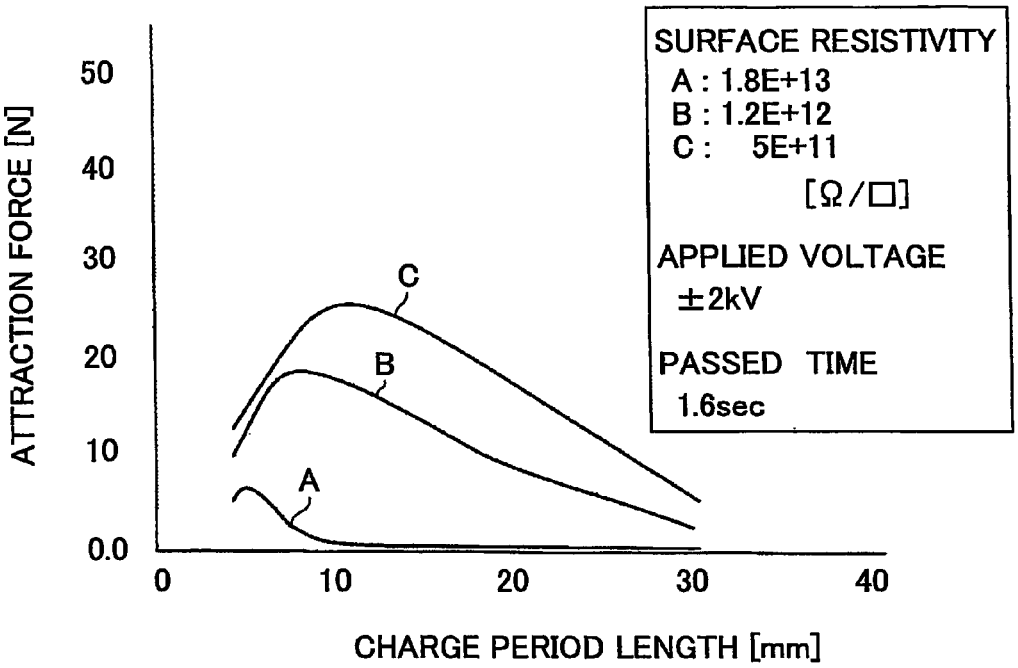
FIG. 12 is a graph showing a relationship between an attraction force and a charge period length with respect to the three kinds of papers.

Additionally, FIG. 12 shows a relationship between an attraction force and a charge period length with respect to the above-mentioned three kinds of recording papers A, B and C having different surface resistivities. In the experiments, the applied voltages was ±2.0 kv and the time period passed from a time when the conveyance belt 21 is brought into contact with the recording paper was 1.6 seconds.

From the results of the experiments, it is appreciated that the charge period length for which the attraction force is maximized differs between the recording papers A, B and C having different resistivities after the predetermined time period has passed (after 1.6 seconds), and the attraction force can be maximized by decreasing the charge period length when the surface resistivity of the recording paper is high.

That is, if the surface potential of a recording paper can be decreased, the attraction force after a predetermined time can be increased, and an offset in landing positions of liquid droplets caused by an influence of an electric field can be prevented and also contamination of a head due to a reverse flow of mist toward the recording head 7 can be prevented, which enables acquisition of both a high conveyance accuracy of the recording paper and a high-quality image.

However, it can be appreciated that if the charge period length is too short as shown in FIG. 12, a raising loss of the AC bias supply part 14 and a contribution rate of a discharge loss generated when a charge is applied to the conveyance belt 21 are increased, and a sufficient amount of charge cannot be applied to the conveyance belt 21, which results in a decrease in the attraction force.

It should be noted that the raising loss of the AC bias supply part 114 is a loss caused by blunting of a voltage rise when switching a voltage. The AC bias supply part 114 (AC bias supply apparatus) used in the present embodiment requires 10 msec, for example, to raise a voltage from 0 to ±2 kV. If, for example, a conveyance speed is 200 mm/sec, a travel distance until the voltage is raised is 2 mm.

Figure 13:
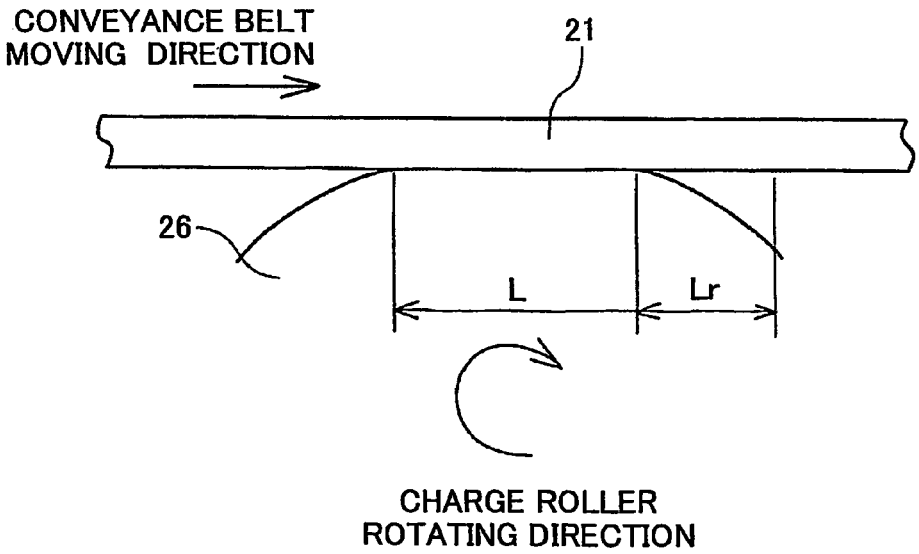
FIG. 13 is an illustration for explaining a discharge loss generated when applying charges onto a conveyance belt.

On the other hand, the discharge loss generated when a charge is applied to the conveyance belt 21 is a loss caused by a corona discharge when applying a voltage. Application of the positive and negative charges from the charge roller 26 to the conveyance belt 21 is performed, as shown in FIG. 13, within a nip portion (indicated by L) where the charge roller 26 and the conveyance belt 21 contact with each other.

When the polarity of the voltage applied to the charge roller 26 is changed, a corona discharge occurs in a corona discharge area Lr on downstream side of the nip portion before the polarity changes, the corona discharge canceling the charge already applied. Thus, the charges that have been applied onto the surface of the conveyance belt 21 is discharged. Such a discharge loss is greatly influenced by a fluctuation of the nip portion of the charge roller 26. If the charge period length is decreased (shortened), the influence cannot be neglected.

Therefore, there is a problem in either case where the charge period length is too long or too short. Thus, it is preferable to control the charge period length to an optimum value in accordance with the surface resistivity of a recording paper.

Figure 14:
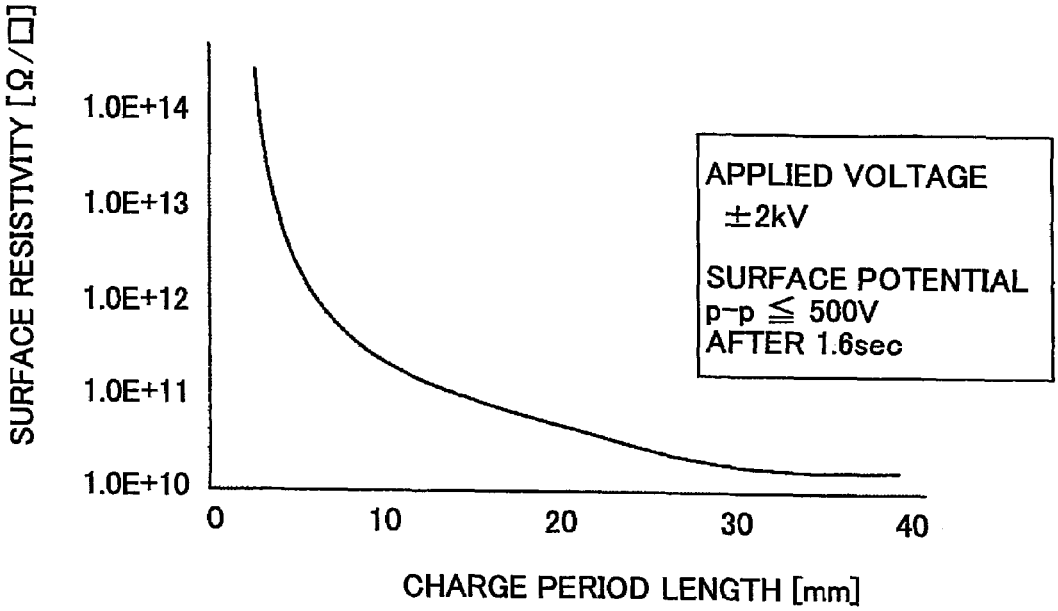
FIG. 14 is a graph showing a relationship between a surface resistivity and a charge period length.

FIG. 14 shows an ideal relationship between the surface resistivity of the paper and the charge period length. Specifically, a relationship of the charge period length at which the surface resistivity and the surface potential of a recording paper after the predetermined time period (1.6 seconds) is equal to or smaller than 500 Vp-p (peak to peak of positive and negative potentials (an absolute value of Max-Min: hereinafter referred to as "p-p")) is shown. In the experiments, when the surface potential is equal to or smaller than 500 Vp-p, it was possible to prevent an offset in landing positions of liquid droplets and prevent contamination of the head plane. Thus, the value of 500 Vp-p is used, but the surface potential is not limited to this value.

It should be noted that the surface resistivity of the recording paper mentioned here is a value obtained by measuring a surface resistivity of a recording paper by applying a voltage of, for example, 1 kV to the surface of the recording paper.

Thus, a description will be given, with reference to FIG. 15, of an example of a charge period length adjusting process for adjusting a surface charge of a recording medium in the image forming apparatus. First, a relationship between a surface resistivity and a charge period length with which the attraction force and the surface potential of the recording paper are optimized is changed into table information, and the table information is stored in the ROM 102 or the like. It should be noted that the table information may be retained by the printer driver 91 in the host 90 and is transferred to the image forming apparatus. The same structure may be used in the following embodiments although a description of the storing location of the table information may be omitted.

Figure 15:
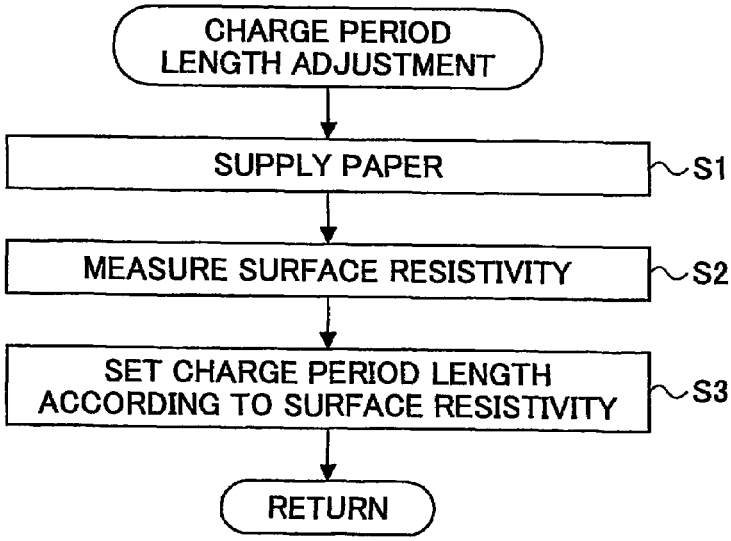
FIG. 15 is a flowchart of a charge period length adjusting process.

Then, as shown in FIG. 15, when the recording paper 12 is supplied in step S1, the surface resistivity of the supplied recording paper is measured (detected), in step S2, by the surface resistance meter 80, and a value corresponding to the surface resistivity of the recording paper 12 is obtained from the table information of the surface resistivity and the charge period length, and the read value is set, in step S3, as the charge period length. Then, by controlling the AC bias supply part 114, the AC bias supply part 114 is caused to output a high-voltage waveform at which a charge operation to the conveyance belt 21 is performed with the thus-set charge period length.

Thereby, the conveyance belt is charged by positive and negative charges with an optimum charge period length in accordance with the surface resistivity of the supplied recording paper 12, and the surface potential under the recording head 7 is controlled and while maintaining an attraction force, the recording paper 12 is attracted to and conveyed by the conveyance belt 21.

Thus, when a recording medium is attracted and conveyed by an electrostatic force generated by applying charges onto the conveyance belt, the charges applied onto the conveyance belt is adjusted so as to weaken the electric field under the recording head in accordance with the resistance value of the recording medium since the resistance value of the recording medium is closely correlated with the charges on the surface of the recording medium on the conveyance belt. Thus, while an accuracy of conveyance can be improved by causing the conveyance belt to attract the recording medium, an offset in the landing positions of liquid droplets due to the electric field under the recording head is prevented and also contamination of the head due to a reverse flow of mist toward the head is prevented, which enables stable formation of a high-quality image.

In this case, by using the surface resistance meter so as to detect the resistance value of the recording medium, the charges on the recording medium under the recording head can be adjusted to be small by accurately and easily detecting the resistance value of the recording medium.

Additionally, in order to adjust the charges on the surface of the recording medium, by changing the charge period length of the positive and negative charges applied onto the conveyance belt, the charges on the recording medium under the recording head can be accurately and easily adjusted to be small.

Figure 16:
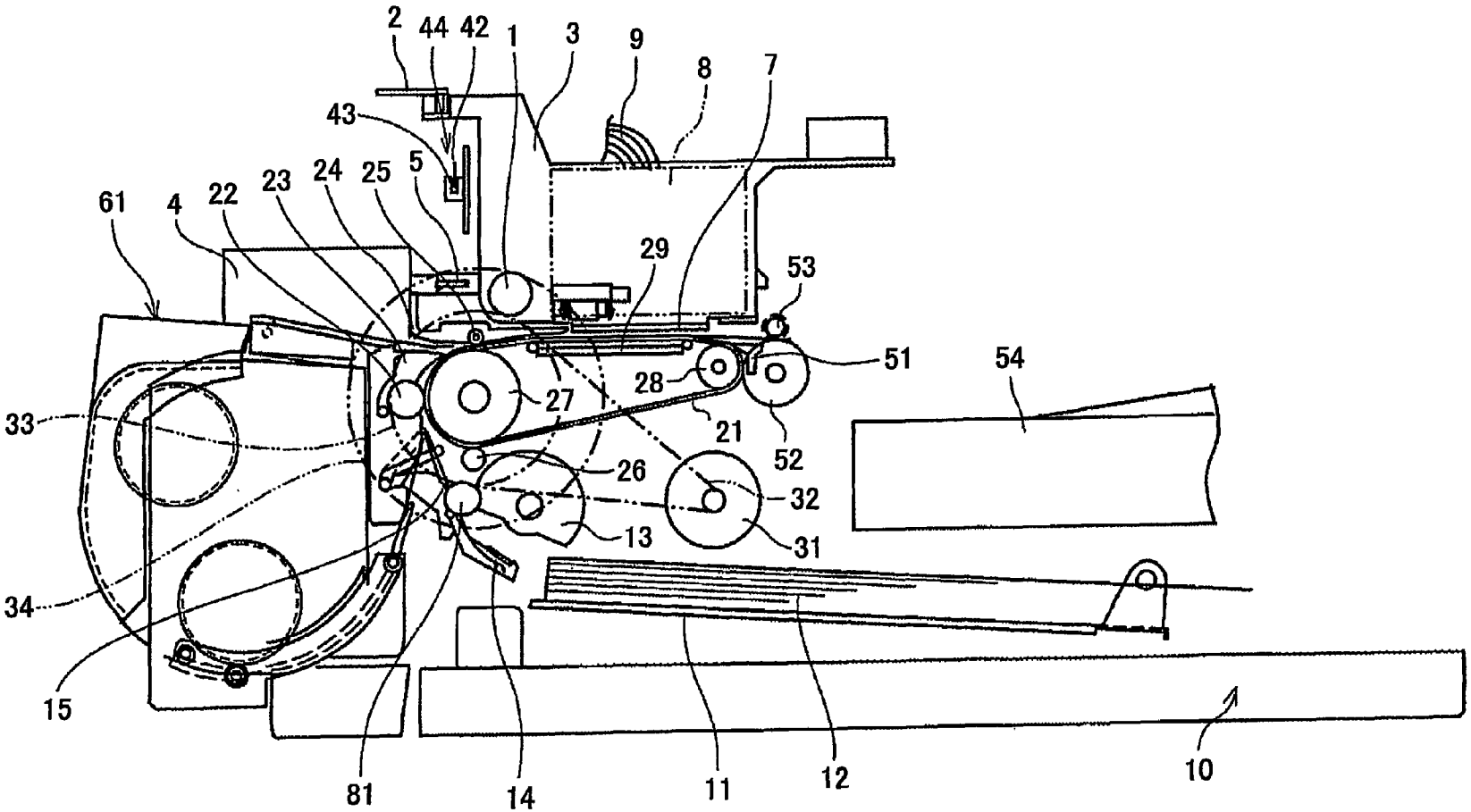
FIG. 16 is an illustrative side view of an image forming apparatus according to a second embodiment of the present invention.
Figure 17:
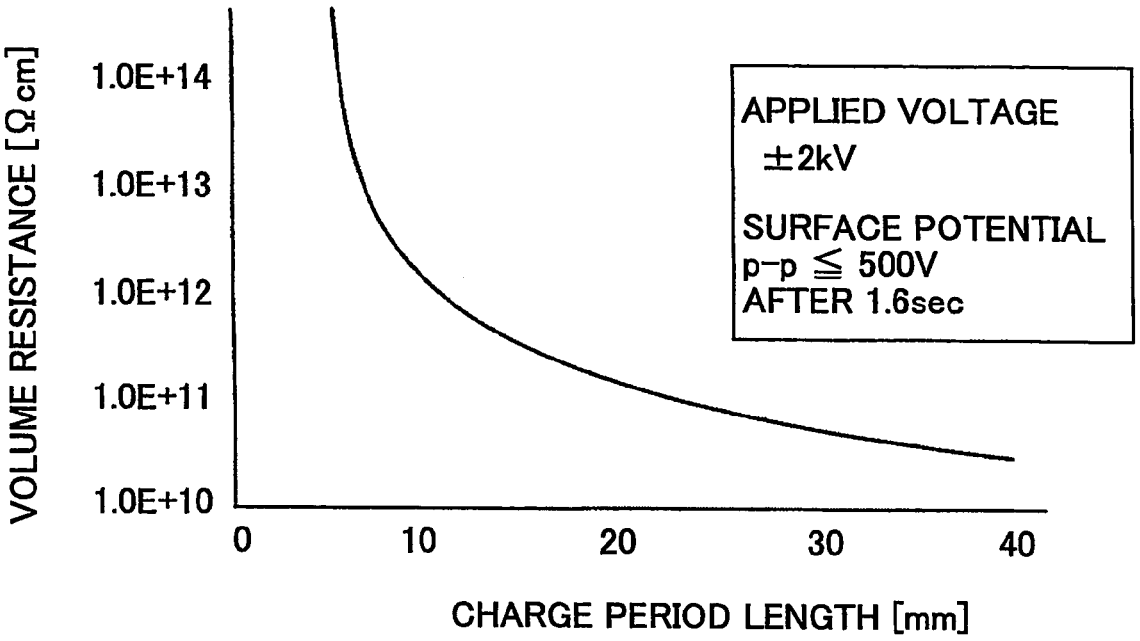
FIG. 17 is a graph showing an ideal relationship between a volume resistance and a charge period length.

A description will now be given, with reference to FIGS. 16 to 18, of an image forming apparatus according to a second embodiment of the present invention. In the second embodiment, as shown in FIG. 16, instead of the surface resistance meter 80 in the first embodiment, a volume resistance meter 81 is provided to detect a volume resistance of the recording paper 12 to be supplied. The volume resistance meter 81 is located at a position on the upstream side of a position where the recording paper 12 is brought into contact with the conveyance belt 21 in the feed direction of the recording paper 12. The volume resistance meter 81 measures a volume resistance of the recording paper by applying a voltage of, for example, 1 kV across both sides of the recording paper 12 while sandwiching the recording paper 12. It should be noted that although a control part is not shown in the figure, the surface resistance meter 80 of the first embodiment can be merely replaced by the volume resistance meter 81.

Similar to the surface resistivity of the recording paper, the volume resistance also has a strong correlation with a time period until charges induced on the recording paper disappear. FIG. 17 shows an example of an ideal relationship between the charge period length and the volume resistance of the recording paper.

Specifically, a relationship of the charge period length at which the volume resistivity and the surface potential of a recording paper after the predetermined time period (1.6 seconds) is equal to or smaller than 500 Vp-p is shown. In the experiments, when the volume potential is equal to or smaller than 500 Vp-p, it was possible to prevent an offset in landing positions of liquid droplets and prevent contamination of the head plane. Thus, the value of 500 Vp-p is used, but the volume potential is not limited to this value. It should be noted that the volume resistance mentioned here is a value measured by applying a voltage of, for example, 1 kV across both sides of a recording paper as mentioned above.

Here, a description will be given, with reference to FIG. 18, of an example of a charge period length adjusting process for adjusting the surface charge of a recording medium in the image forming apparatus according to the present invention. First, a relationship, such as shown in FIG. 17, between a volume resistance and a charge period length with which the attraction force and the surface potential of the recording paper are optimized is changed into table information, and the table information is stored in the ROM 102 or the like.

Figure 18:
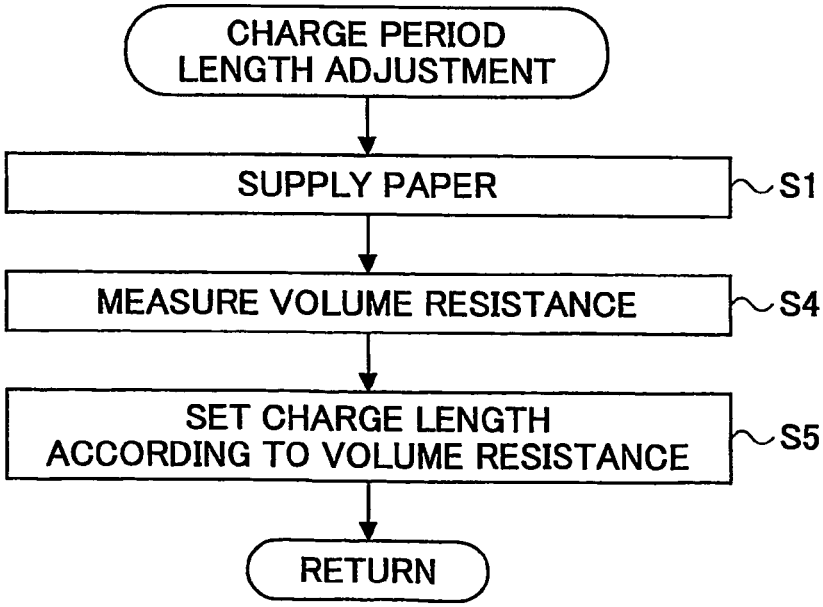
FIG. 18 is a flowchart of a charge period length adjusting process.

Then, as shown in FIG. 18, when the recording paper 12 is supplied in step S1, the volume resistance of the supplied recording paper is measured (detected), in step S4, by the volume resistance meter 81, and a value corresponding to the volume resistance of the recording paper 12 is obtained from the table information of the volume resistance and the charge period length, and the read value is set, in step S5, as the charge period length. Then, by controlling the AC bias supply part 114, the AC bias supply part 114 is caused to output a high-voltage waveform at which a charge operation to the conveyance belt 21 is performed with the thus-set charge period length.

Thereby, the conveyance belt is charged by positive and negative charges with an optimum charge period length in accordance with the surface resistivity of the supplied recording paper 12, and the surface potential under the recording head 7 is controlled and while maintaining an attraction force, the recording paper 12 is attracted to and conveyed by the conveyance belt 21.

Thus, by using the volume resistance meter for detecting the volume resistance of the recording medium, the resistance value of the recording medium can be accurately and easily detected so that the charges on the recording medium under the recording head can be adjusted to be small.

Figure 19:
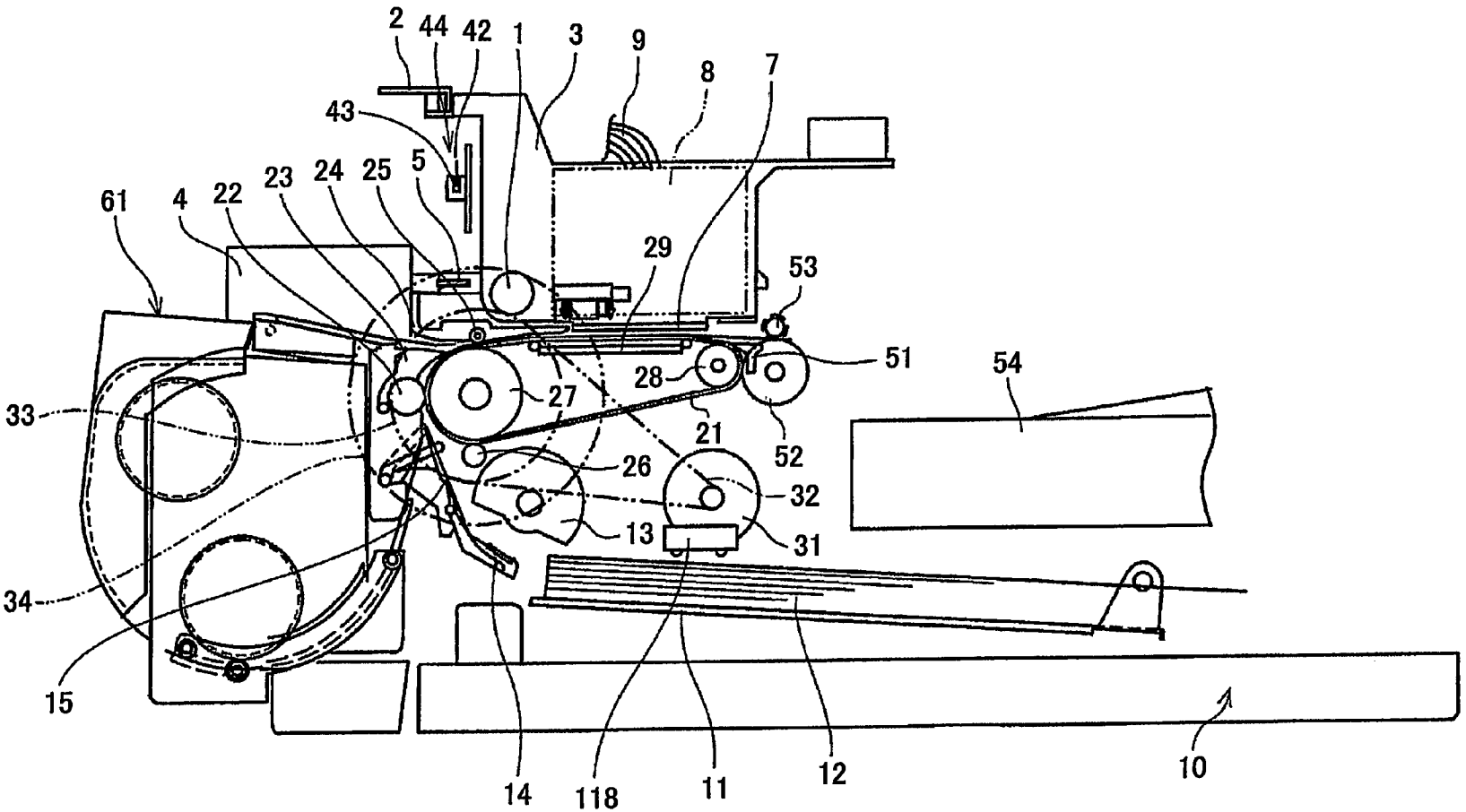
FIG. 19 an illustrative side view of an image forming apparatus according to a third embodiment of the present invention.

A description will now be given, with reference to FIGS. 19 through 26, of an image forming apparatus according to a third embodiment of the present invention. In the third embodiment, as shown in FIG. 19, instead of the surface resistance meter 80 of the first embodiment, an environment sensor 118 for detecting a temperature and a humidity of an environment where a recording paper being fed is placed is used so as to presume a resistance value of the recording paper 12 being fed in accordance with the environmental temperature and the environmental humidity. It should be noted that although the environmental sensor 118 in the first embodiment is commonly used, separate temperature sensor and humidity sensor may be provided.

Figure 20:
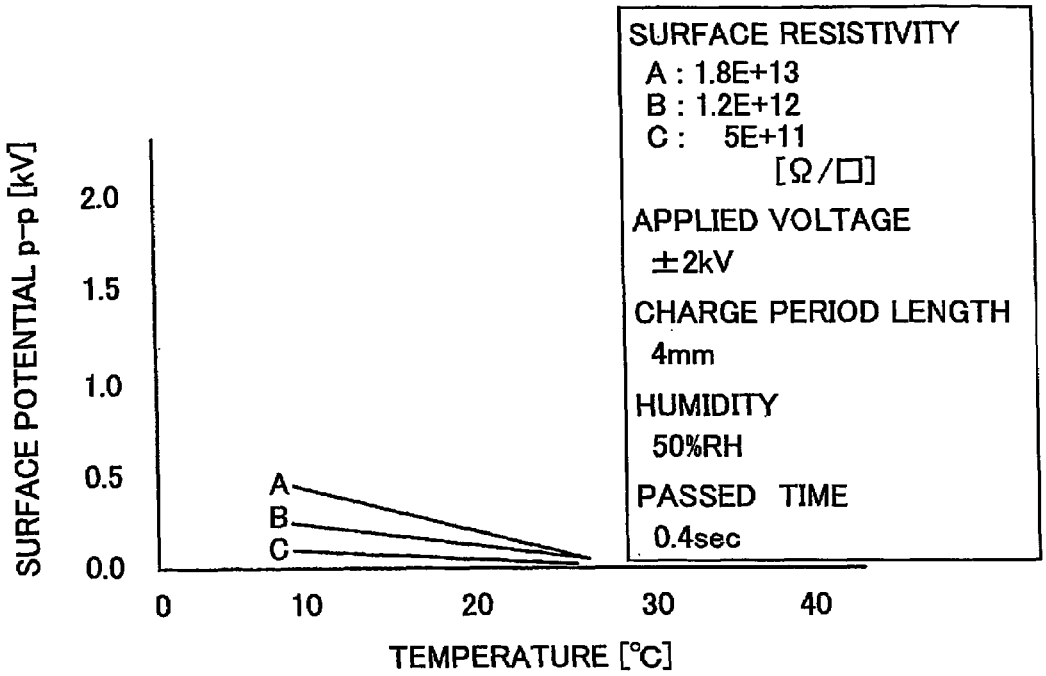
FIG. 20 is a graph showing a relationship between a surface potential and a temperature with respect to three kinds of recording papers.

That is, the resistance value of a recording paper correlate with a temperature and a humidity. For example, FIG. 20 shows an example of measurement results of a relationship between a surface potential p-p and a temperature with respect the three kinds of recording papers (A, B and C) having different surface resistivities. In the experiments, the applied voltage was ±2.0 kV, the charge period length was 4 mm, the humidity was set to 50% RH and a time period from a time when the conveyance belt and the recording paper are brought into contact with each other was 0.4 seconds.

Figure 21:
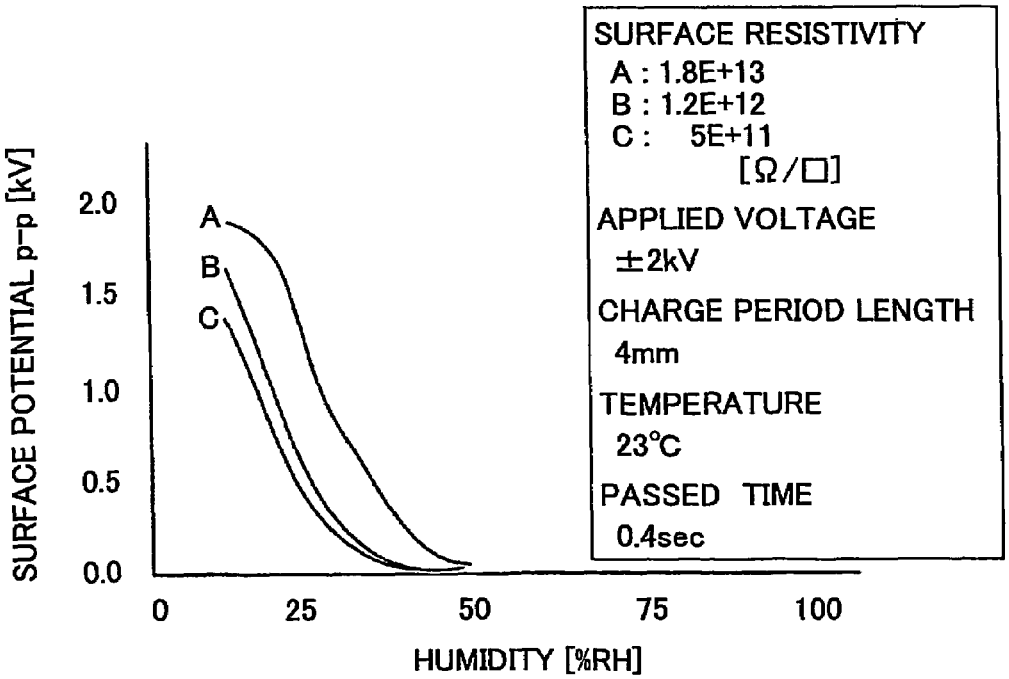
FIG. 21 is a graph showing a relationship between a surface potential and a humidity with respect to the three kinds of recording papers.

Additionally, FIG. 21 shows an example of measurement results of a relationship between a surface potential p-p and humidity with respect the three kinds of recording papers (A, B and C) having different surface resistivities. In the experiments, the applied voltage was ±2.0 kV, the charge period length was 4 mm, the temperature was set to 23° C. and a time period from a time when the conveyance belt and the recording paper are brought into contact with each other is 0.4 seconds.

Figure 22:
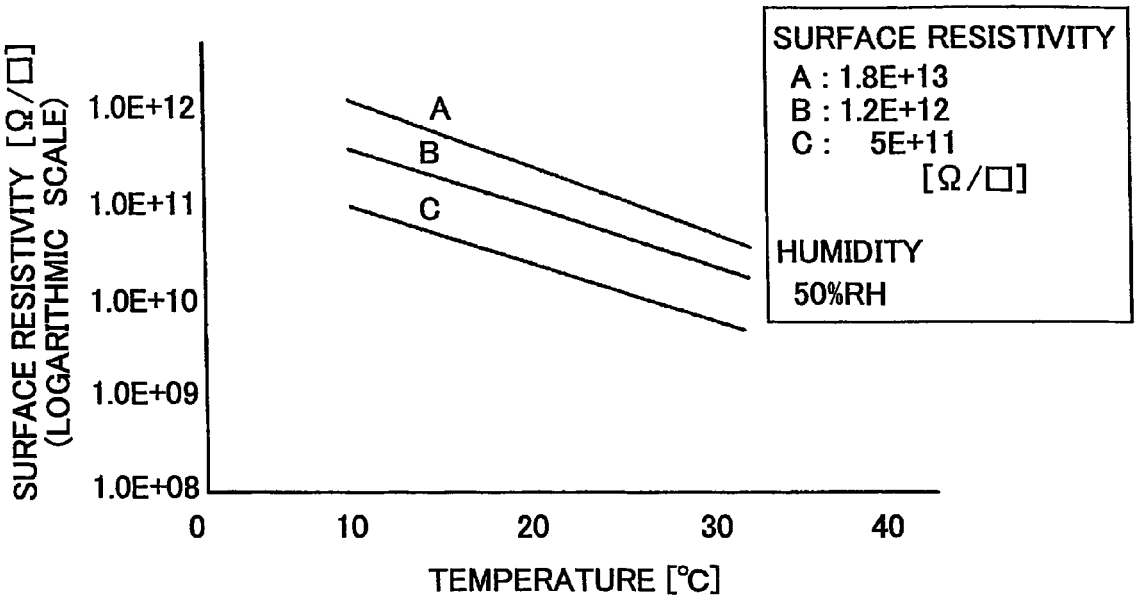
FIG. 22 is a graph showing a relationship between a surface resistivity and a temperature with respect to the three kinds of recording papers.
Figure 23:
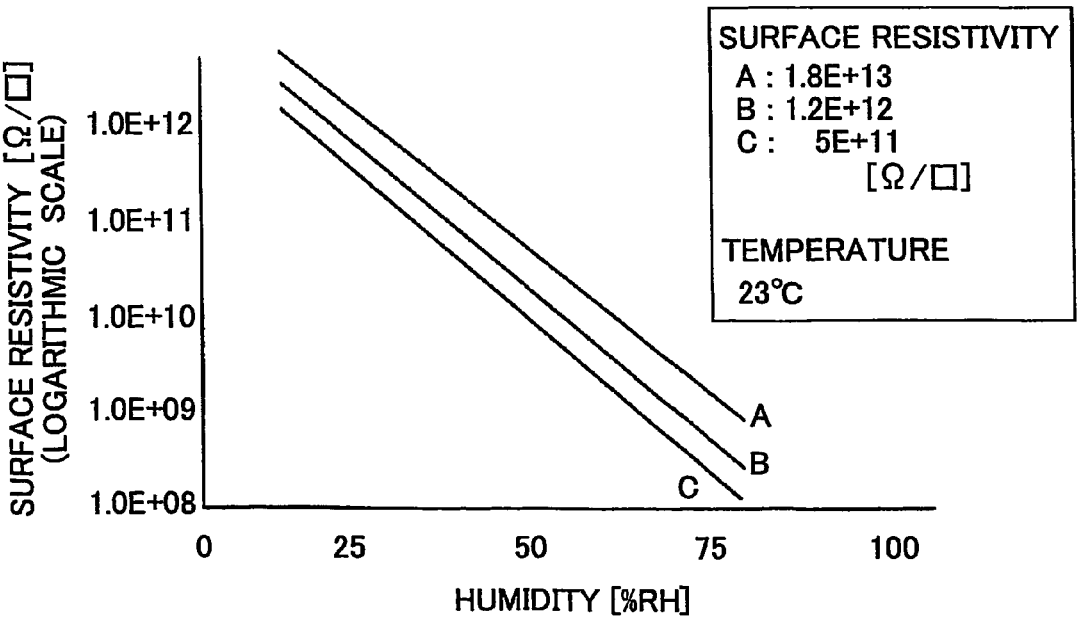
FIG. 23 is a graph showing a relationship between a surface resistivity and a humidity with respect to the three kinds of recording papers.

Further, FIG. 22 shows an example of measurement results of a relationship between a surface resistivity and a temperature with respect to the three kinds of recording papers (A, B and C) having different surface resistivities. In the experiments, humidity was set to 50% RH. Similarly, FIG. 23 shows an example of measurement results of a relationship between a surface resistivity and humidity with respect to the three kinds of recording papers (A, B and C) having different surface resistivities. In the experiments, temperature was set to 23° C.

As mentioned above, the surface resistivity of the recording paper 12 changes according to the environmental temperature and the environmental humidity, which results in a change in the surface potential p-p.

Figure 24:
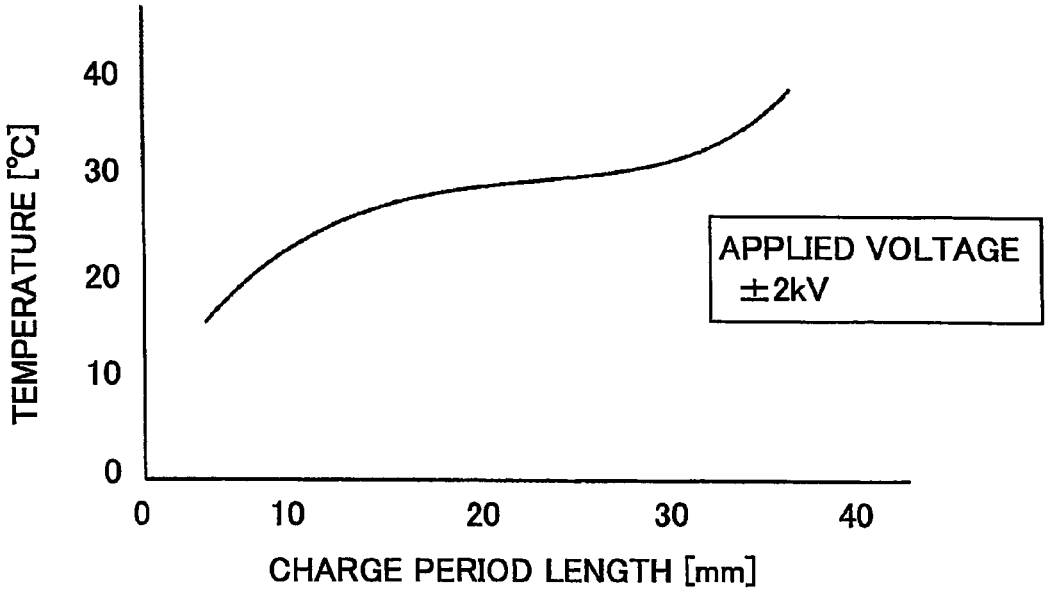
FIG. 24 is a graph showing a relationship between a temperature and a charge period length.
Figure 25:
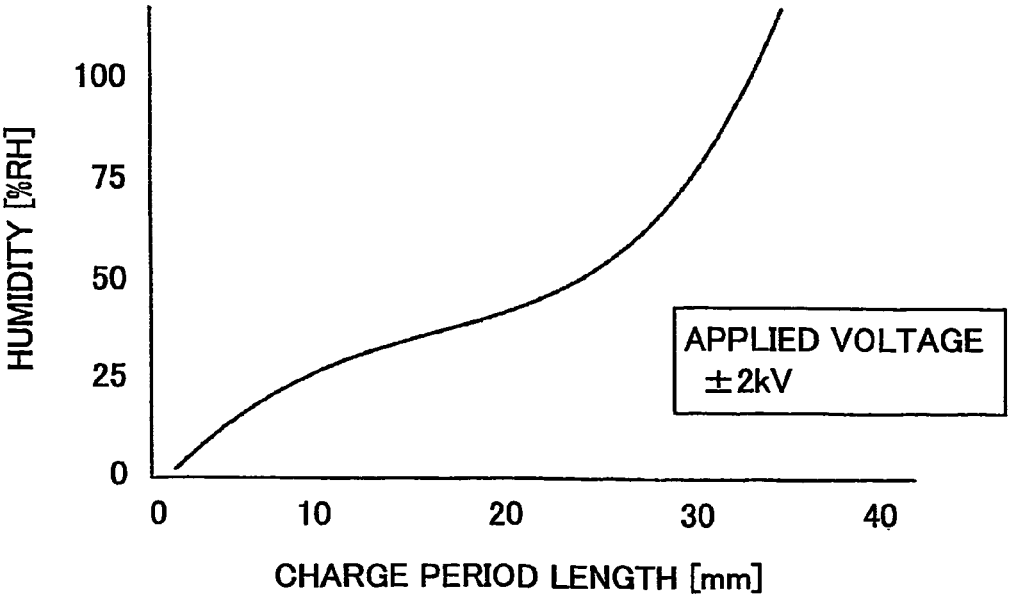
FIG. 25 is a graph showing a relationship between a humidity and a charge period length.

Thus, a description will be given, with reference to FIG. 26, of an example of a charge period length adjustment process for adjusting a surface charge of a recording medium in the image forming apparatus according to the present invention. First, a relationship, such as shown in FIGS. 24 and 25, between a temperature and humidity and a charge period length with which the attraction force and the surface potential of the recording paper are optimized is changed into table information, and the table information is stored in the ROM 102.

Figure 26:
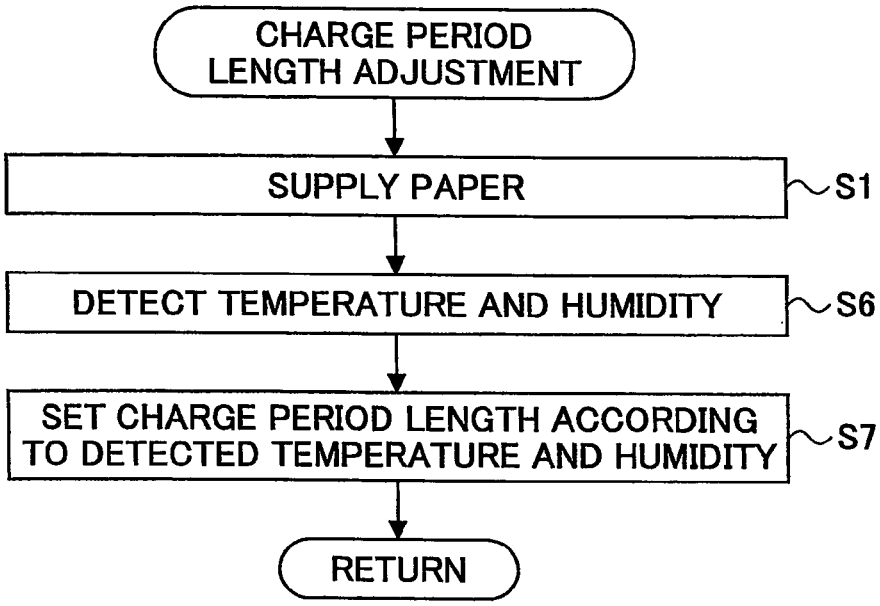
FIG. 26 is a flowchart of a charge period length adjusting process.

Then, as shown in FIG. 26, when the recording paper 12 is supplied in step S1, an environmental temperature and an environmental humidity are detected, in step S6, by the environment sensor 118 when the recording paper 12 is being fed, and a value corresponding to the detected environmental temperature and the detected environmental humidity is obtained from the table information of the environmental temperature and humidity and the charge period length, and the read value is set, in step S7, as the charge period length.

Then, by controlling the AC bias supply part 114, the AC bias supply part 114 is caused to output a high-voltage waveform at which a charge operation to the conveyance belt 21 is performed with the thus-set charge period length.

Thereby, the conveyance belt is charged by positive and negative charges with an optimum charge period length in accordance with the environmental temperature and the environmental humidity when the recording paper is being fed, and the surface potential under the recording head 7 is controlled and while maintaining an attraction force, the recording paper 12 is attracted to and conveyed by the conveyance belt 21.

Thus, by presuming the resistance value of the recording medium based on the environmental temperature and the environmental humidity, the charges on the surface of the recording medium under the recording head can be accurately and easily adjusted in accordance with the resistance value of the recording medium.

A description will now be given, with reference to FIG. 27, of an image forming apparatus according to a fourth embodiment of the present invention. In the fourth embodiment, information regarding a correlation of a resistance value of the recording paper 12 is given from the printer driver 91 of the host 90 to the image forming apparatus. It should be noted that the image forming apparatus according to the present invention has the same structure as that of the first embodiment except for the surface resistance meter being omitted, and illustration and descriptions thereof will be omitted.

That is, in the present embodiment, table information of an optimum charge period length is stored beforehand in the ROM 102 with respect to information correlating with a resistance value of the recording paper given from the host 90, or the table information is transferred from the host 90 and is stored in the RAM 104 or the RAM 103. It should be noted that the table information may be stored in the printer driver of the host 90, and information regarding the charge period length may be directly transferred to the image forming apparatus.

Figure 27:
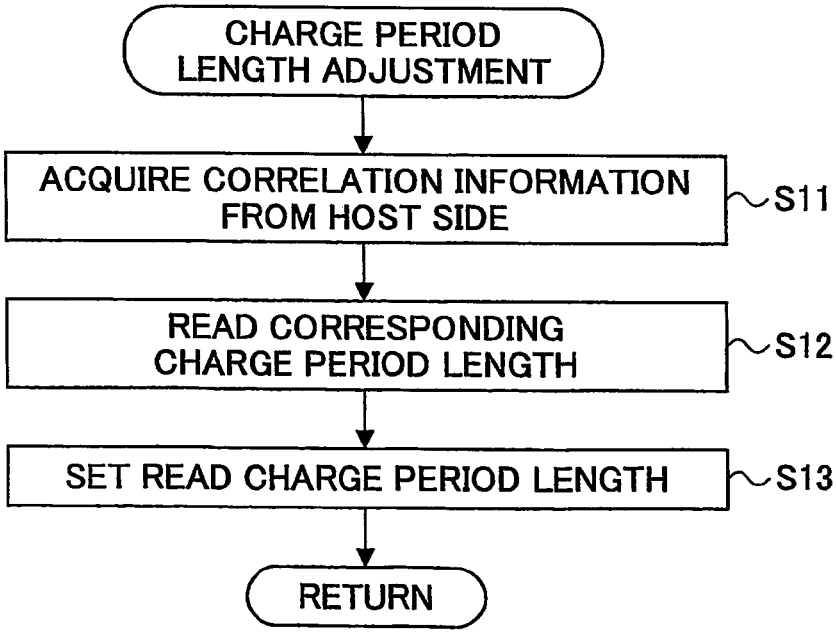
FIG. 27 is a flowchart of a charge period length adjusting process performed in an image forming apparatus according to a fourth embodiment of the present invention.

Then, as shown in FIG. 27, the information regarding a resistance value of the recording paper 12 transferred from the host 90 is acquired in step S11, and a value for the charge period length corresponding to the acquired information is read, in step S12, by referring to the table information, and, then, the read value is set, in step S13, as the charge period length in step S13. Then, by controlling the AC bias supply part 114, the AC bias supply part 114 is caused to output a high-voltage waveform at which a charge operation to the conveyance belt 21 is performed with the thus-set charge period length.

Thereby, the conveyance belt 21 is charged by positive and negative charges with an optimum charge period length in accordance with the environmental temperature and the environmental humidity when the recording paper is being fed, and the surface potential under the recording head 7 is controlled and while maintaining an attraction force, the recording paper 12 is attracted to and conveyed by the conveyance belt 21.

It should be noted that when selecting an optimum charge period length by the printer driver 91 of the host 90, the information regarding the charge period length is acquired so as to control the AC bias supply part 114 according to the acquired charge period length.

The information regarding a correlation of a resistance value of the recording paper mentioned here is not limited to a kind of recording paper which an operator supplied when printing (for example, a kind of recording paper such as a regular paper, a coated paper, an OHP sheet or a glossy paper, or a high-resistance paper and a low-resistance paper of which resistance can be presumed by a user according to a condition separately set by the use), but contains information regarding a region of use or date of use which are automatically input from the host side. For example, if the region of use is Tokyo (Japan) and the date of use is February, a temperature and humidity can be presumed based on the information (in this case, low-humidity may be presumed).

As mentioned above, by presuming a resistance value of the recording medium by receiving the information regarding a correlation of the resistance value of the recording medium from the host side (external part), the charges on the surface of the recording medium under the recording head can be accurately and easily adjusted in accordance with the resistance value of the recording medium.

Figure 28:
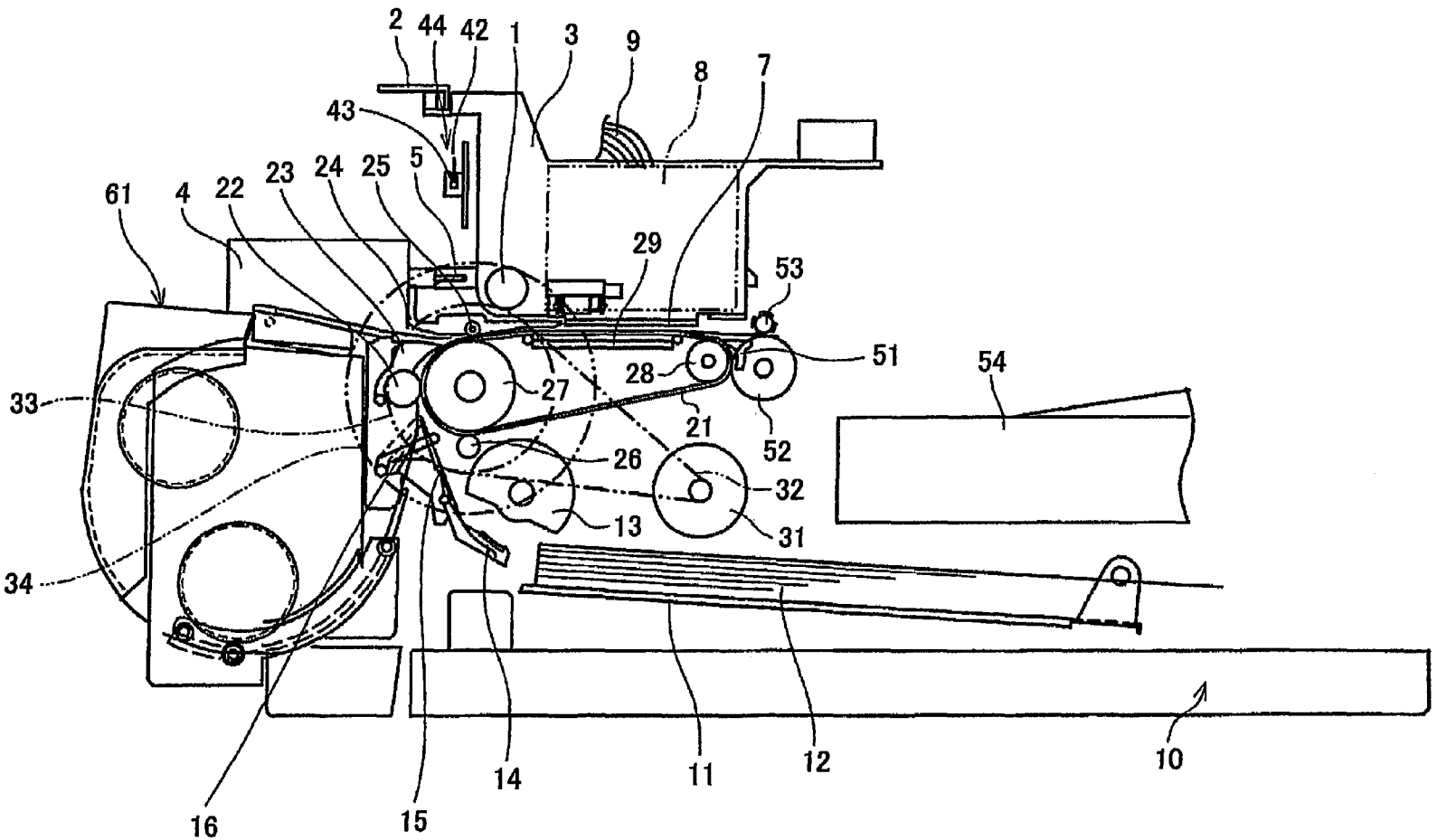
FIG. 28 is an illustrative side view of an image forming apparatus according to a fifth embodiment of the present invention.

A description will now be given, with reference to FIGS. 28 through 30, of an image forming apparatus according to a fifth embodiment of the present invention. In the fifth embodiment, as shown in FIG. 28, a detection lever 16 is provided movably back and force in the paper feed path of the recording paper 12. Additionally, a paper detection sensor 120 is provided to detect a presence of the recording paper by a photosensor, which detects a swing motion of the detection lever 16, so as to detect a leading edge and a trailing edge of a recording paper 12 based on a detection signal of the paper detection sensor 120. It should be noted that structures of other parts are the same as that of the first embodiment except for the surface resistance meter 80 being omitted, and descriptions thereof will be omitted.

In the above-mentioned first through fourth embodiments, an entire surface of the recording paper is brought into contact with the conveyance belt 21 applied with charges with uniform charge period length, and, thus, the surface potential on the recording paper and the attraction force to the recording paper 12 under the recording head are constant regardless of positions of the leading and trailing edges of the recording paper 12.

In such a case, there is no problem if a resistance of the recording paper 12 can be accurately measured or presumed (a reduction in the surface potential on the recording paper corresponds to the charge period length for generating the attraction force to the recording paper). However, when a resistance value of the recording paper is presumed based on information from the humidity sensor or the host side, a robust characteristic with respect to variation must be given in consideration of variation in the presumed value. That is, it is necessary to control to eliminate a problem even when a resistance value of a recording paper is out of a presumed range to certain extent.

Here, in areas of leading and trailing edges, a lift of an edge of a recording paper tends to occur, and an attraction force of a certain level must be generated if there is variation in a presumed resistance value. On the other hand, in an image forming area of a recording paper, it is necessary to decrease the surface potential even if there is variation in the presumed resistance value so as to prevent an offset of landing positions of ink droplets and contamination of the head due to a reverse flow of mist toward the recording head due to an influence of an electric field.

From this point of view, in the present embodiment, attention is given to the fact that priority levels for controlling to reduce a surface potential on the recording surface and for controlling to generate an attraction force under the recording head 7 are different according to positions of the recording paper, such as, for example, a leading edge portion, a middle portion, or a trailing edge portion. That is, a control is made to reduce the surface potential in the image forming area even if a presumed resistance value fluctuates, and a control is made to generate a sufficient attraction force in the leading and trailing edge areas where a lift of the recording paper tends to occur even if the presumed resistance valued fluctuates so as to give a robust characteristic with respect to variation in the presumed resistance value.

A description will be given, with reference to FIG. 30, of a charge control process for the conveyance belt of the image forming apparatus. When a printing process is started, first, the recording paper 12 is supplied in step S21. At this time, a relative positional relationship between the recording paper 12 and the charges applied on the conveyance belt 21 is detected by detecting a leading edge and a trailing edge off the recording paper 12 based on the detection signal of the paper detection sensor 120.

Then, it is determined, in step S22, whether or not a part of the surface of the conveyance belt 21 is to be brought into contact with the recording paper 12. If the determination is affirmative, positive and negative charges are applied, in step S23, to the part of the surface of the conveyance belt 21 with a predetermined charge period length, which gives a priority to an attraction force with respect to the presumed resistance value. Thereafter, it is determined, in step S24, whether or not a part of the surface of the recording paper to be brought in contact with the conveyance belt 21 is an image forming area (a blank middle portion). If it is determined that the part of the surface of the recording paper 12 is the blank middle portion, positive and negative charges are applied, in step S25, to the conveyance belt 21 with a different predetermined charge period length, which gives a priority to reduction of a surface potential on the recording paper with respect to variation in the presumed resistance. Then, the routine returns to step S24.

On the other hand, if the determination of step S22 is negative, the routine proceeds to step S26 where it is determined whether or not the printing process is ended. If the printing process is ended, it is determined, in step S27, whether or not there is a next printing process. If there is not a next printing process, the recording paper 12 is ejected in step S28, and the routine is ended. On the other hand, if the determination of step S26 is negative, the routine returns to step S22. Additionally, if it is determined, in step S27, that there is a next printing process, the routine returns to step S22 so as to repeat the printing process.

For example, it can be appreciated from the results of experiments shown in FIG. 12, if the charge period length is set to 6 mm, certain attraction forces can be generated for each of the three kinds of recording papers (A, B and C) having different resistances. Thus, the predetermined charge period length is set to 6 mm in the process of step S23. Additionally, it can be appreciated from the results of experiments shown in FIG. 11 that if the charge period length is set to 2 mm, a surface potential can be reduced smaller than the above-mentioned target value of 500 p-p for each of the three kinds of recording papers (A, B and C).

Therefore, when the leading edge area and the trailing edge area are brought into contact with the conveyance belt 21, the positive and negative charges are applied to the conveyance belt 21 with the predetermined charge period length of, for example, 6 mm by giving a priority to the attraction force with respect to variation in the presumed resistance value. On the other hand, when an image forming area (a blank middle portion) is brought into contact with the conveyance belt 21, the positive and negative charges are applied to the conveyance belt 21 with the different predetermined charge period length of, for example, 2 mm by giving a priority to reduction of a surface potential on the recording paper with respect to variation in the presumed resistance value. Thereby, both the improvement of conveyance and the improvement of image quality can be achieved simultaneously at a higher level for various kinds of recording papers having different resistances.

As mentioned above, when conveying a recording medium by attracting by an electrostatic force generated by applying charges to the conveyance belt, since the control of the charges applied to the conveyance belt to acquire an attraction force does not always consistent with the control of the charges applied to the conveyance belt to reduce the charges induced on the surface of the recording medium, the charges on the surface of the recording medium is adjusted based on the result of detection of a relative position of the recording medium with respect to the charges applied to the conveyance belt. That is, by performing the control to generate an appropriate attraction force with respect to a leasing edge area and a trailing edge area of the recording medium and also performing the control to reduce charges on the middle part of the surface of the recording medium, on which middle part an image is to be printed, an accuracy of conveyance can be improved and a high-quality image can be stably formed without an offset in landing positions of liquid droplets and contamination of the head due to a reverse flow of mist toward the recording head due to an electric field under the recording head.

Figure 31:
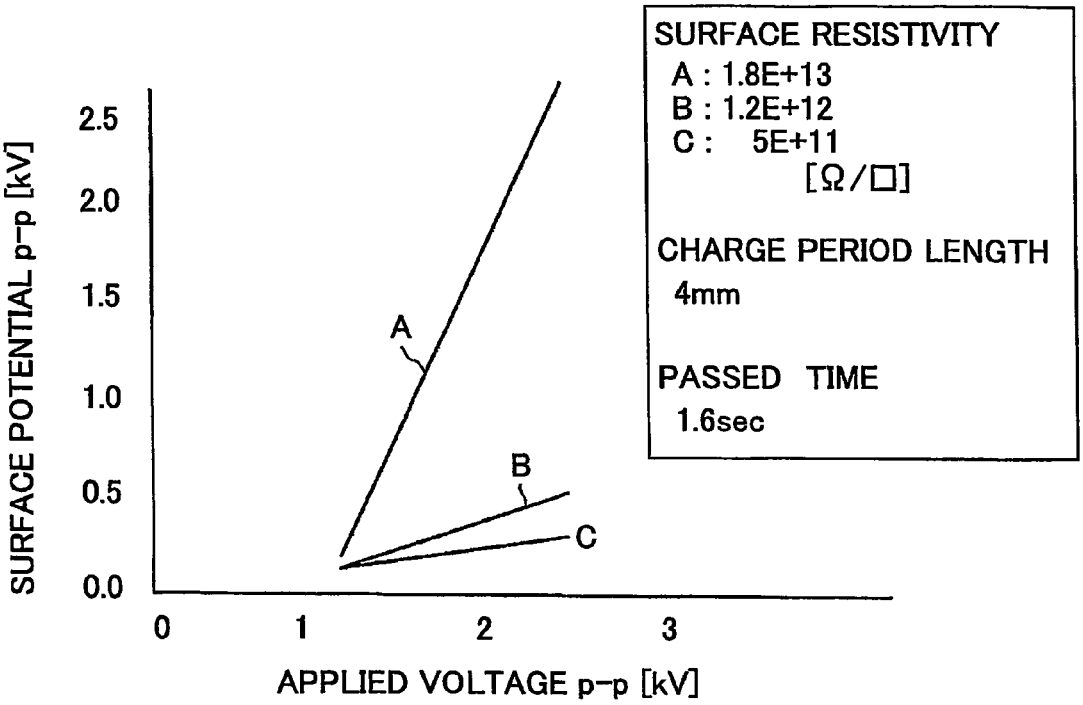
FIG. 31 is a graph showing a relationship between a surface potential and an applied voltage with respect to three kinds of recording papers for explaining an image forming apparatus according to a sixth embodiment of the present invention.
Figure 32:
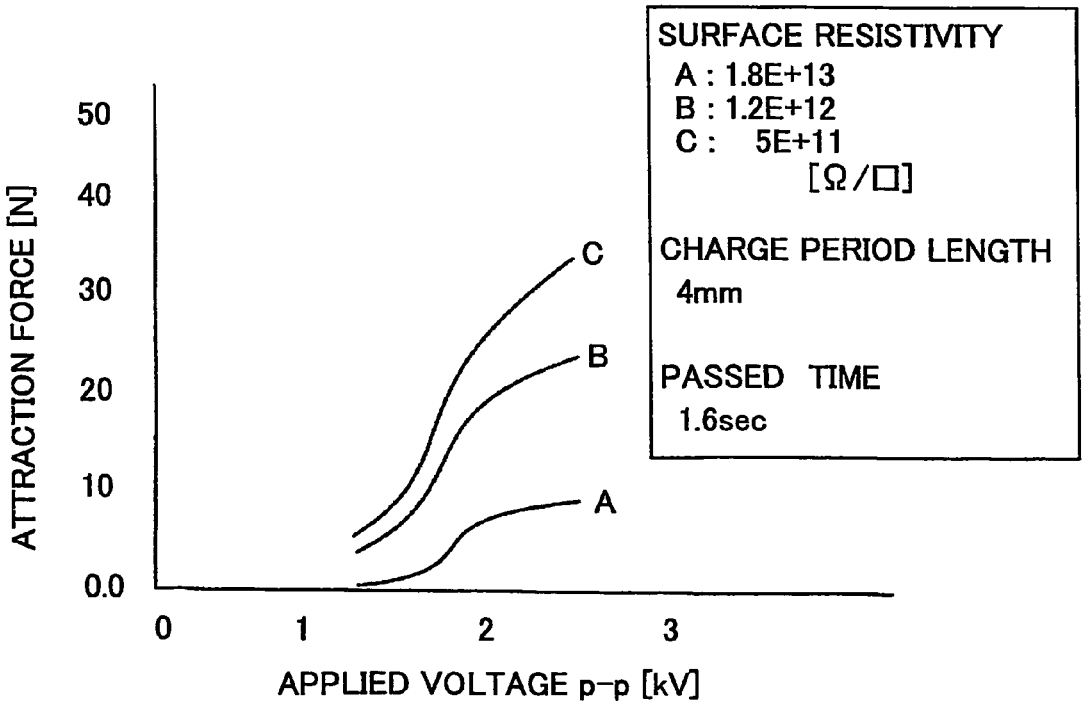
FIG. 32 is a graph showing a relationship between an attraction force and an applied voltage with respect to the three kinds of recording papers.
Figure 33:
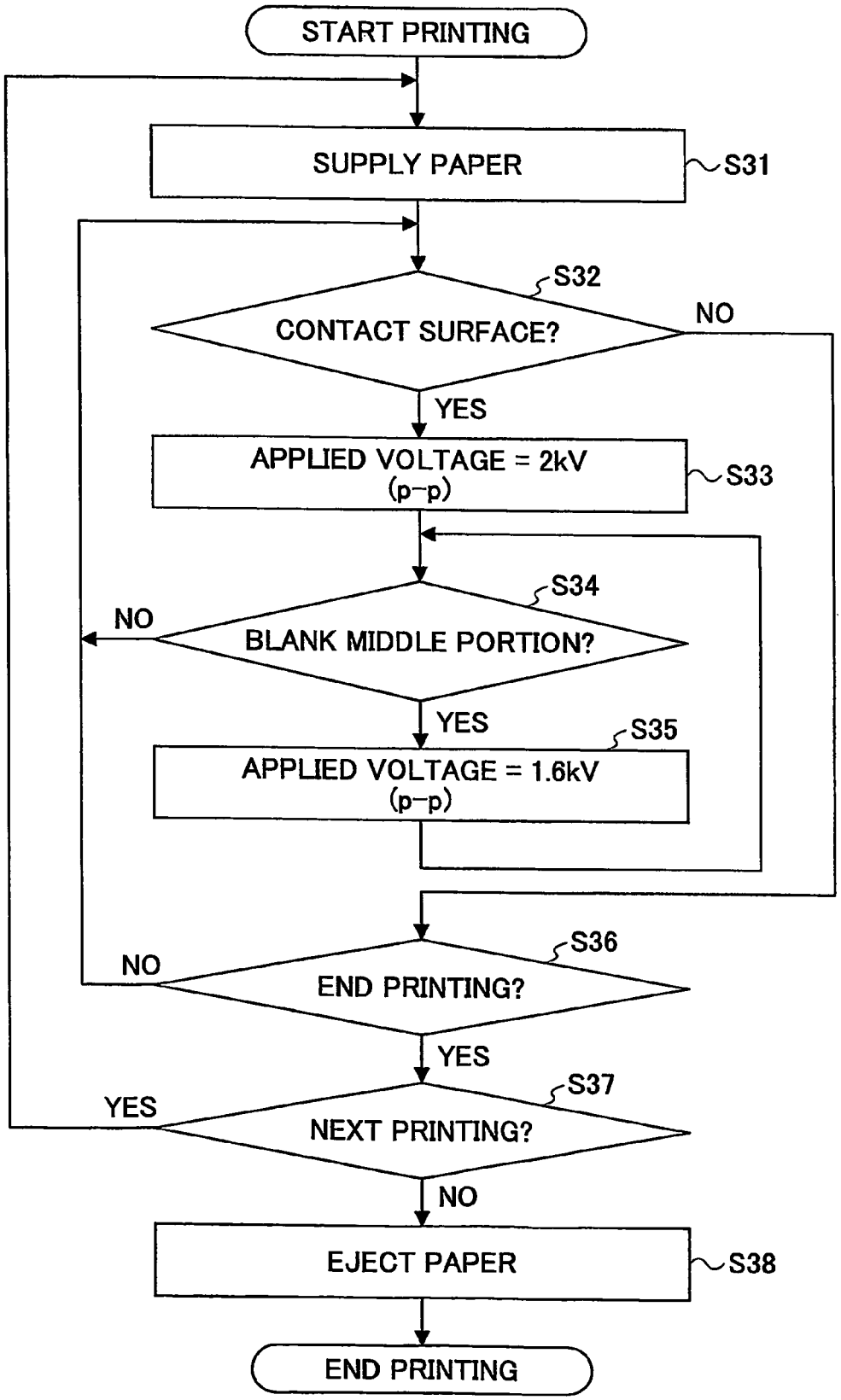
FIG. 33 is a flowchart of a charge control process performed in the image forming apparatus according to the sixth embodiment of the present invention.

A description will bed given, with reference to FIGS. 31 through 33, of an image forming apparatus according to a sixth embodiment of the present invention. In the sixth embodiment, the voltage of high-voltage waveform output from the AC bias supply part 114 when charging the conveyance belt 21 is adjusted (varied) instead of adjusting the charge period length to adjust the surface potential on the recording paper under the recording head 7 as in the above-mentioned fifth embodiment.

That is, since the surface potential on the recording paper 12 under the recording head 7 receives influence of a total amount of positive and negative charges applied to the conveyance belt 21, the surface potential can be controlled by changing the applied voltage p-p when applying charges to the conveyance belt 21. It should be noted that FIG. 31 shows an example of results of measurement of the surface potential when the applied voltage is changed with respect to the above-mentioned three kinds of recording papers (A, B and C).

Therefore, the surface potential on the recording paper under the recording head 7 can be reduced by reducing the applied voltage. Since the applied voltage and the attraction force are related so that the attraction force is reduced if the applied voltage is reduced as shown in FIG. 32, it is difficult to reduce the applied voltage to an extremely small value. However, if a relationship between the resistance of a recording paper and the applied voltage, which gives an optimum value of the surface potential of the recording paper 12 is represented by table information and the applied voltage is changed in accordance with a portion of the recording paper 12 and a portion of the conveyance belt 21 (relative positional relationship) as in the above-mentioned fifth embodiment, a sufficient effect can be obtained.

A description will be given, with reference to FIG. 33, of a charge control process for the conveyance belt in the image forming apparatus according to the present embodiment. Similar to the fifth embodiment, when a printing process is started, first, the recording paper 12 is supplied in step S31. At this time, a relative positional relationship between the recording paper 12 and the charges applied on the conveyance belt 21 is detected by detecting a leading edge and a trailing edge of the recording paper 12 based on the detection signal of the paper detection sensor 120. Then, it is determined, in step S32, whether or not a part of the surface of the conveyance belt 21 is to be brought into contact with the recording paper 12. If the determination is affirmative, positive and negative charges are applied, in step S33, to the portions of the conveyance belt 21, which is brought into contact with the leading edge area and the trailing edge area of the conveyance belt 21, with a predetermined applied voltage (for example, an applied voltage p-p of 2.0 kV), which gives a priority to an attraction force.

Thereafter, it is determined, in step S34, whether or not a part of the surface of the recording paper to be brought into contact with the conveyance belt 21 is an image forming area (a blank middle portion). If it is determined that the part of the surface of the recording paper 12 is the blank middle portion, positive and negative charges are applied, in step S35, to the portion of the conveyance belt 21, which is to be brought into contact with the image forming area (blank middle portion) of the recording paper 12), with a different predetermined applied voltage, which gives a priority to reduction of a surface potential on the recording paper 12 under the recording head 7. Then the routine returns to step S35.

On the other hand, if the determination of step S32 is negative, the routine proceeds to step S36 where it is determined whether or not the printing process is ended. If the printing process is ended, it is determined, in step S37, whether or not there is a next printing process. If there is not a next printing process, the recording paper 12 is ejected, in step S38, and the routine is ended. On the other hand, if the determination of step S36 is negative, the routine returns to step S32. Additionally, if it is determined, in step S37, that there is a next printing process, the routine returns to step S31 to repeat the printing process.

According to the above-mentioned process, both the improvement of conveyance and the improvement of image quality can be achieved simultaneously at a higher level, which provides the same effects as the above-mentioned fifth embodiment.

A description will now be given of an image forming apparatus according to a seventh embodiment of the present invention. In the seventh embodiment, the surface potential on the recording paper under the recording head 7 is adjusted (varied) by eliminating the applied voltage to the conveyance belt 21 instead of adjusting the charge period length or the applied voltage as in the above-mentioned fifth or sixth embodiment. That is, the surface potential on the recording paper 12 under the recording head 7 can be reduced by eliminating the application of charges to the conveyance belt 21 since the surface potential is influenced by a total amount of the positive and negative charges applied to the conveyance belt 21.

If charges are not applied, an attraction force is not generated. However, if a relationship between the resistance of a recording paper and a timing of application of a voltage, which gives an optimum value of the surface potential of the recording paper 12, is represented by table information and the applied voltage (high-voltage output) is turned on and off in accordance with a portion of the recording paper 12 as in the above-mentioned fifth embodiment, a sufficient effect can be obtained.

Figure 34:
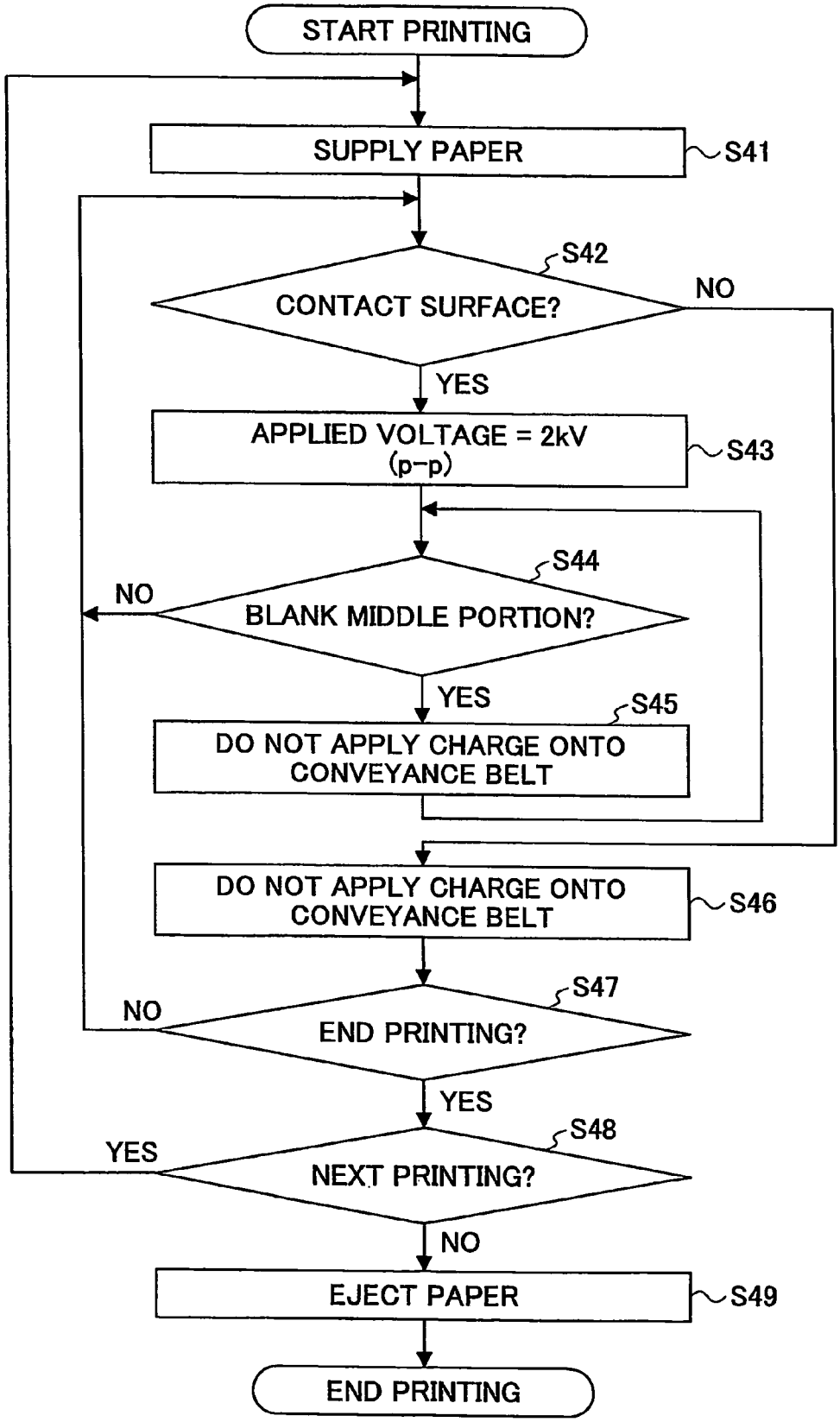
FIG. 34 is a flowchart of a charge control process performed in an image forming apparatus according to a seventh embodiment of the present invention.

A description will now be given, with reference to FIG. 34, of a charge control process of the conveyance belt in the image forming apparatus. When a printing process is started, first, the recording paper 12 is supplied in step S41. At this time, a leading edge and a trailing edge of the recording paper 12 are detected based on the detection signal of the paper detection sensor 120. Then, it is determined, in step S42, whether or not a portion of the surface of the conveyance belt 21 is to be brought into contact with the recording paper 12. If the determination is affirmative, the applied voltage p-p is set to 2 kV in step S43. Then, it is determined, in step S44, whether or not a portion of the recording paper, which portion is brought into contact with the contact belt 21, is an image forming area (blank middle portion). If the determination is affirmative, the routine proceeds to step S45 where no charge is applied to the conveyance belt, and, then, the routine returns to step S44. On the other hand, if the determination of step S44 is negative, the routine returns to step S42.

If the determination of step S42 is negative, the routine proceeds to step S46 where not charge is applied to the conveyance belt 21. Then, it is determined, whether or not the printing process is ended. If the printing process is ended, it is determined, in step S48, whether or not there is a next printing process. If there is not a next printing process, the recording paper 12 is ejected, in step S49, and the routine is ended. On the other hand, if the determination of step S47 is negative, the routine returns to step S42. Additionally, if it is determined, in step S48, that there is a next printing process, the routine returns to step S41 so as to repeat the printing process.

According to the above-mentioned process, the positive and negative charges are applied to portions of the conveyance belt 21, which portions are brought into contact with the leading edge area and the trailing edge area of the recording paper 12, by the applied voltage (for example, the applied voltage p-p of 2.0 kV), and no charges are applied to a portion of the conveyance belt 21, and, thereby, both the improvement of conveyance and the improvement of image quality can be achieved simultaneously at a high level and the same effects as the above-mentioned fifth and sixth embodiments can be obtained. It should be noted that although no charge is applied to the image forming area (blank middle portion), the surface potential and the attraction force can be achieve simultaneously by controlling predetermined intervals to repeat application and elimination of charges in the image forming area (blank middle portion), which enables to achieve the improvement of conveyance and the improvement of image quality simultaneously.

Figure 35:
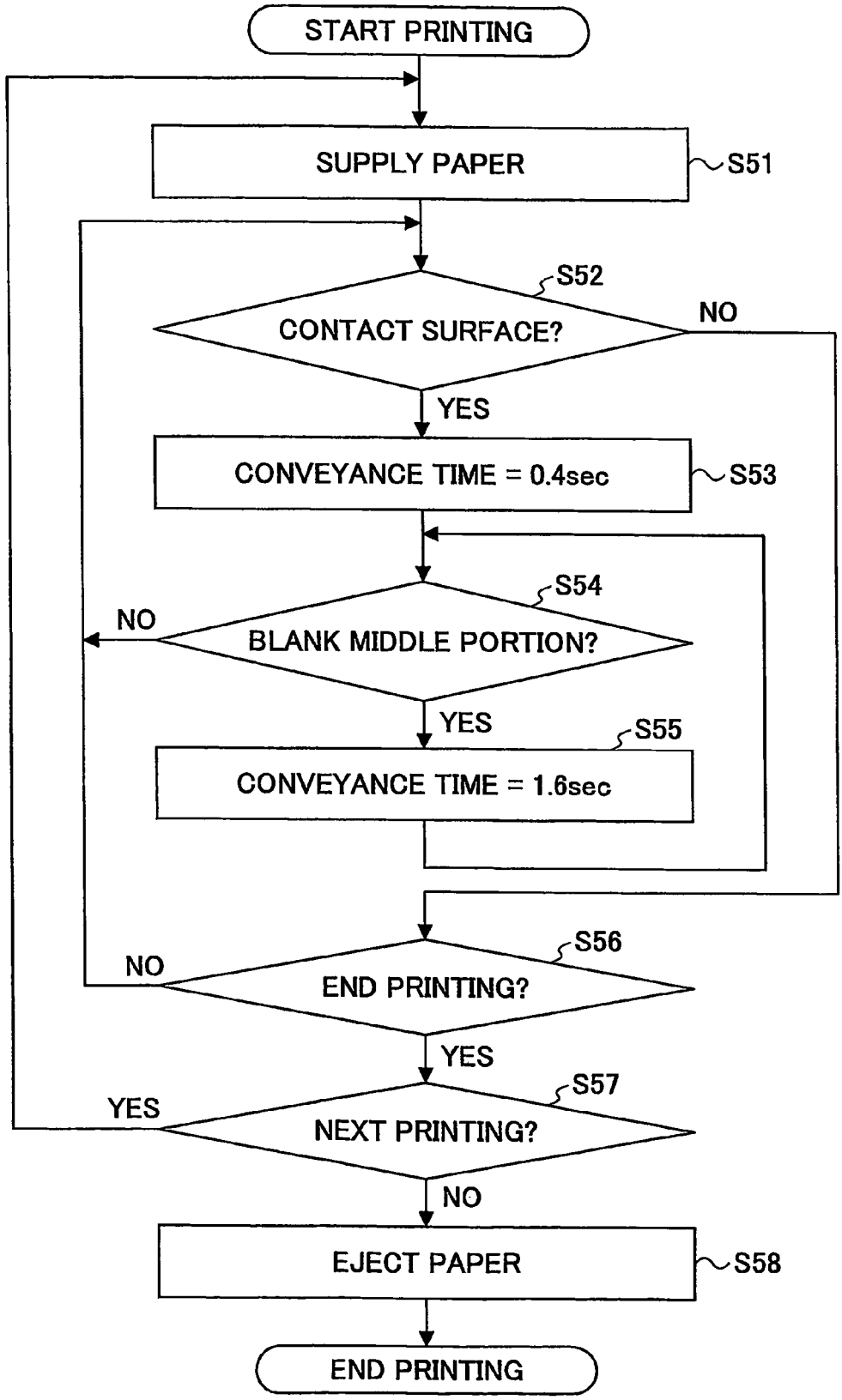
FIG. 35 is a flowchart of a charge control process performed in an image forming apparatus according to an eighth embodiment of the present invention.

A description will now be given, with reference to FIG. 35, of an image forming apparatus according to an eighth embodiment of the present invention. In the eighth embodiment, the surface potential on the recording paper under the recording head 7 is adjusted by adjusting (varying) a time period from a time when the recording paper 12 is brought into contact with the conveyance belt 21 until a time when the recording paper 12 reaches an image forming position under the recording head 7, instead of adjusting the charge period length or the applied voltage as in the above-mentioned fifth or sixth embodiment.

That is the surface potential on the recording paper 12 decreases with passage of time as the positive and negative charges induced on the recording paper 12 moves toward each other and neutralized. Accordingly, since the surface potential under the recording head 17 changes according to a time period from a time when the recording paper 12 is brought into contact with the conveyance belt 21 until a time when the recording paper 12 reaches a position under the recording head 7, the surface potential can be reduced by increasing the conveyance time. In order to adjust the conveyance time, a conveyance speed may be changed or a stop time may be provided during conveyance. As mentioned before with reference to FIG. 9, there is a correlation between the charge period length and a time until the surface potential of the recording paper reaches the target value of 500 Vp-p. It should be noted that the results of experiments shown in the figure is an example in which the paper resistance is $1.8\times 10^{13}\Omega/\square$, and the applied voltage is ±2 kV. It can be appreciated that if the charge period length is long, it takes a long time for the surface potential on the surface of the recording paper to be reduced, and the charge is reduced with passage of time for any charge period length.

A description will be given, with reference to FIG. 35, of a charge control process of the conveyance belt in the image forming apparatus. When a printing process is started, first, the recording paper 12 is supplied in step S51. At this time, a leading edge and a trailing edge of the recording paper 12 are detected based on the detection signal of the paper detection sensor 120. Then, it is determined, in step S52, whether or not a portion of the surface of the conveyance belt 21 is to be brought into contact with the recording paper 12. If the determination is affirmative, a conveyance time is set to 0.4 seconds in step S53. Then, it is determined, in step S54, whether or not a portion of the recording paper, which portion is brought into contact with the contact belt 21, is an image forming area (blank middle portion). If the determination is affirmative, the routine proceeds to step S55 where the conveyance time is set to 1.6 seconds, and, then, the routine returns to step S54. On the other hand, if the determination of step S54 is negative, the routine returns to step S52.

If the determination of step S52 is negative, the routine proceeds to step S56 where it is determined whether or not the printing process is ended. If the printing process is ended, it is determined, in step S57, whether or not there is a next printing process. If there is not a next printing process, the recording paper 12 is ejected, in step S58, and the routine is ended. On the other hand, if the determination of step S56 is negative, the routine returns to step S52. Additionally, if it is determined, in step S57, that there is a next printing process, the routine returns to step S51 so as to repeat the printing process.

According to the above-mentioned process, the recording paper 12 is conveyed to the position under the recording head 7 with the conveyance time period (for example, 1.6 sec) exceeding the predetermined time period (for example, 0.4 sec) when the surface of the recording paper to be brought into the conveyance belt 21 is an image forming area (blank middle portion), and, thus, both the improvement of conveyance and the improvement of image quality can be simultaneously achieved at a higher level and the same effects as the above-mentioned fifth and sixth embodiment can be obtained. It should be noted that if both instructions are mixed, the instruction regarding the image forming area (blank middle portion) is given a priority so as to reduce the surface potential under the recording head 7 can be decreased to a value smaller than a predetermined surface potential, which enables improvement in both the conveyance and the image quality.

A description will now be given, with reference to FIGS. 36 and 37, of an image forming apparatus according to a ninth embodiment of the present invention. In each of the above-mentioned embodiments, the intensity of the electric field generated by the surface potential on the recording paper under the recording head 7 is adjusted so as to reduce an offset in landing positions of ink droplets and contamination of the recording head 7 due to a reverse flow of mist toward the recording head 7.

However, if the intensity of the electric field, which gives influences to ink droplets, is the same, a behavior of ink droplets within the electric field varies depending oh the size of each of the ink droplets.

FIGS. 36A through 36D and FIGS. 37A through 37D are illustrations showing a behavior of an ink droplet discharged from the recording head 7 to the recording paper 12 attracted by the conveyance belt 21. FIGS. 36A through 36D show a behavior of an ink droplet of 40 pl for a 300 dpi image. FIGS. 37A through 37D show a behavior of an ink droplet of 20 pl for a 600 dpi image.

Figure 36A:
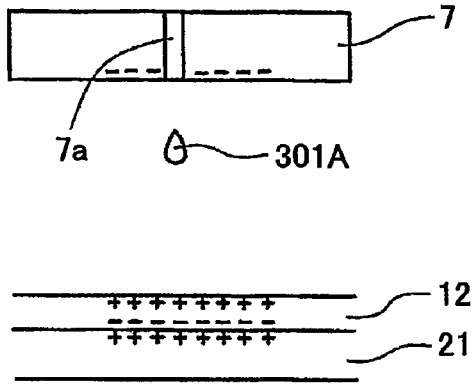
FIG. 36A through 36D are illustrations for explaining a behavior of a large liquid droplet.
Figure 36B:
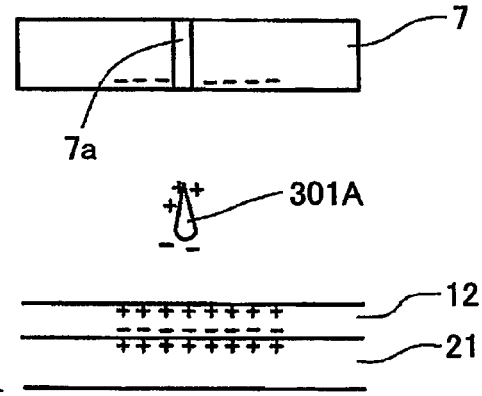
Figure 36C:
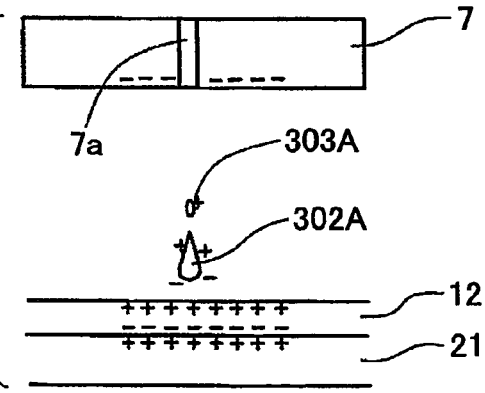
Figure 36D:
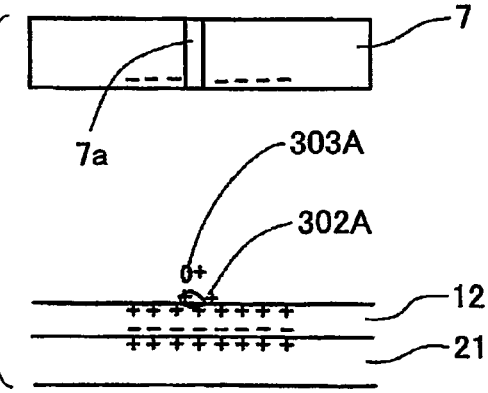
Figure 37A:
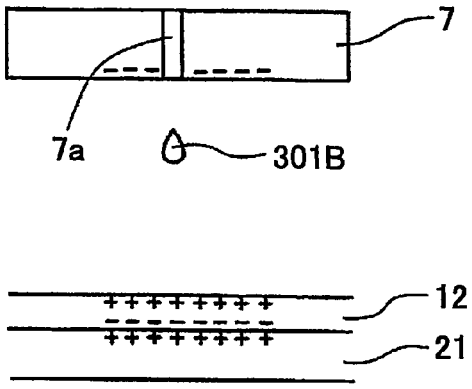
FIG. 37A through 37D are illustrations for explaining a behavior of a small liquid droplet.
Figure 37B:
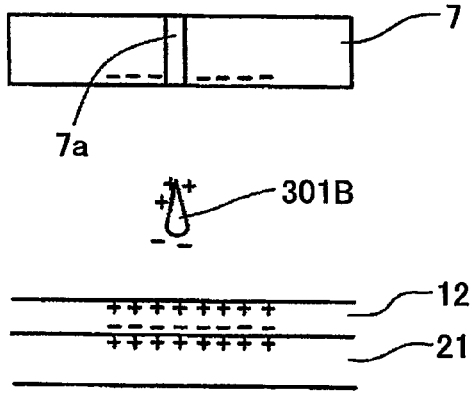
Figure 37C:
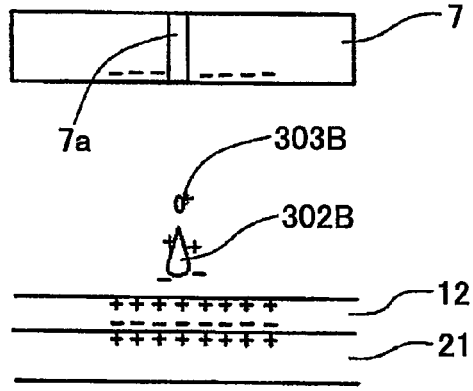
Figure 37D:
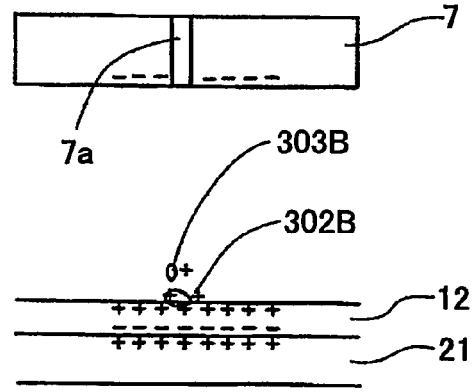

As shown in FIGS. 36A and 37A, the ink droplets, 301A and 301B are discharged from a nozzle 7*a* of the recording head 7. The ink droplets 301A and 301B are influenced by an electric field generated by the surface potential on the recording paper 12 which is attracted by the conveyance belt 21, and a true charge is induced on the ink droplets 301A and 301B as shown in FIGS. 36B and 37B. Thus, the ink droplets 301A and 301B are broken into main droplets 302A and 302B and mist (sub-droplets) 303A and 303B, respectively, as shown in FIGS. 36C and 37C. Since the mist 303A and 303B is charged in many cases to the same polarity as the recording paper 12, the mist repulses with the charge on the recording paper 12, and the mist reversely flows toward the recording head 7 and adheres on a part of the recording head in the vicinity of the ink discharge plane as shown in FIGS. 36D and 37D.

Therefore, an amount of ink adhering on the recording head 7 depends on an amount of mist produced when the ink droplet is broken. Thus, an amount of ink adhering on the recording head 7 in the case of the 600 dpi ink droplet having a shorter tail is less than that of the case of the 300 dpi ink droplet.

Thus, by changing the charge period length of the positive and negative charges applied to the conveyance belt 21 in accordance with the size of the ink droplet, both the reduction of an amount of ink adhered on the recording head 7 and the good conveyance performance of the recording paper 12 can be more effectively achieved simultaneously.

Moreover, although an amount of ink adhered to the recording head 7 in the case of 600 dpi ink droplet is smaller than that of the 300 dpi ink droplet in experiments, this does not apply to a case where a different drive waveform of an actuator element of the recording head is used or a different kind of ink is used. If a relationship between an amount of ink adhered and property of the ink droplet is changed into table information, and an appropriate charge period length is determined in accordance with data (for example, image quality or resolution) from the host side (printer driver side), which sends a print command, both the reduction of an amount of ink adhered on the recording head 7 and the good conveyance performance of the recording paper 12 can be more effectively achieved simultaneously.

As mentioned above, a degree of influence of the electric field given to an ink droplet varies according to the size of the ink droplet. That is, there is a correlation that the mist tends to be produced and easily receives influence of the electric field as the size of the ink droplet is increased. Thus, by adjusting the charges on the surface of the recording medium under the recording head in accordance with liquid droplets for forming an image on the recording medium, an accuracy of conveyance can be improved, and also a high-quality image can be stably formed without an offset of landing positions of the liquid droplets and a reverse flow of mist toward the recording head due to the electric field under the recording head.

Figure 38A:
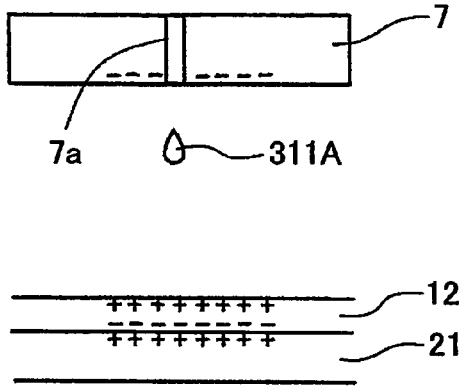
FIG. 38A through 38D are illustrations for explaining a behavior of a low-viscosity liquid droplet.
Figure 38B:
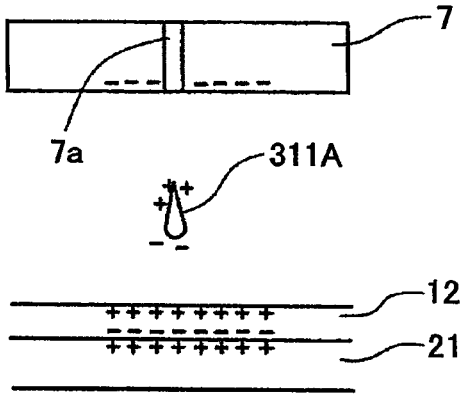
Figure 38C:
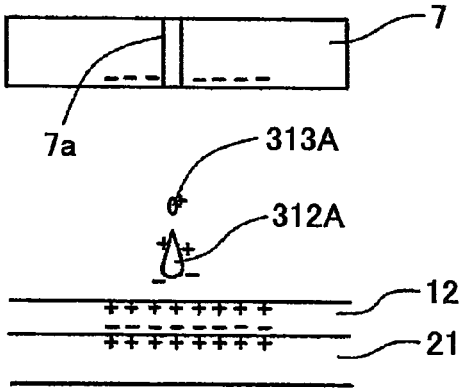
Figure 38D:
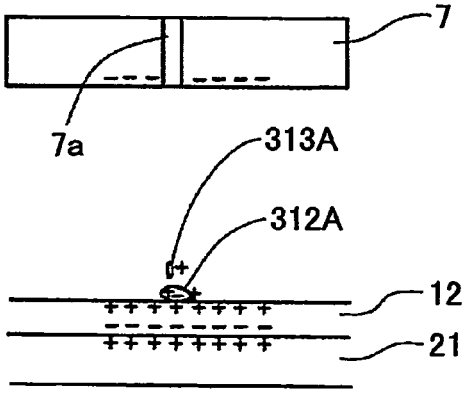
Figure 39A:
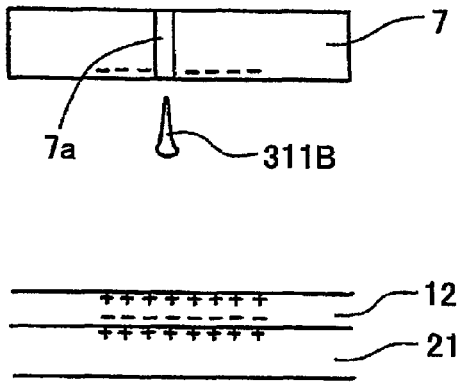
FIG. 39A through 39D are illustrations for explaining a behavior of a high-viscosity liquid droplet.
Figure 39B:
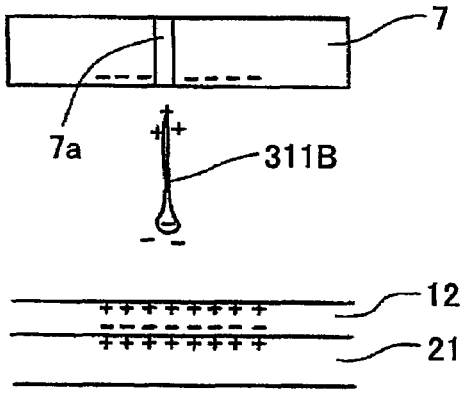
Figure 39C:
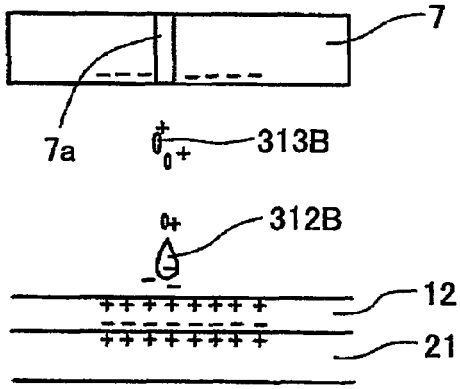
Figure 39D:
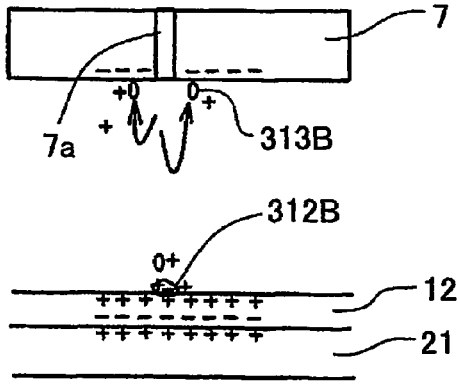

A description will now be given, with reference to FIGS. 38 and 39, of an image forming apparatus according to a tenth embodiment of the present invention. In the tenth embodiment, a viscosity of ink is used as a condition that changes the charge period length of the positive and negative charges applied to the conveyance belt 21. FIGS. 38A through 38D and FIGS. 39A through 39D are illustrations showing a behavior of an ink droplet discharged from the recording head 7 to the recording paper 12 attracted by the conveyance belt 21. FIGS. 38A through 38D show a behavior of an ink droplet having a low viscosity. FIGS. 39A through 39D show a behavior of an ink droplet having a high viscosity. As shown in FIGS. 38A and 39A, the ink droplets 311A and 311B are discharged from a nozzle 7*a* of the recording head 7. The ink droplets 311A and 311B are influenced by an electric field generated by the surface potential on the recording paper 12 which is attracted by the conveyance belt 21, and a charge is induced on the ink droplets 311A and 311B as shown in FIGS. 38B and 39B. Thus, the ink droplets 311A and 311B are broken into main droplets 312A and 312B and mist (sub-droplets) 313A and 313B, respectively, as shown in FIGS. 38C and 39C. Since the mist 313A and 313B is charged in many cases to the same polarity as the recording paper 12, the mist repulses with the charge on the recording paper 12, and the mist reversely flows toward the recording head 7 and adheres on a part of the recording head in the vicinity of the ink discharge plane as shown in FIGS. 36D and 37D.

Therefore, an amount of ink adhering on the recording head 7 depends on an amount of mist produced when the ink droplet is broken. Thus, an amount of ink adhering on the recording head 7 in the case of the low viscosity ink droplet having a shorter tail, is less than that of the case of the high viscosity ink droplet having a longer tail. Thus, by changing the charge period length of the positive and negative charges applied to the conveyance belt 21 in accordance with the viscosity of the ink droplet, both the reduction of an amount of ink adhered on the recording head 7 and the good conveyance performance of the recording paper 12 can be more effectively achieved simultaneously.

Figure 40:
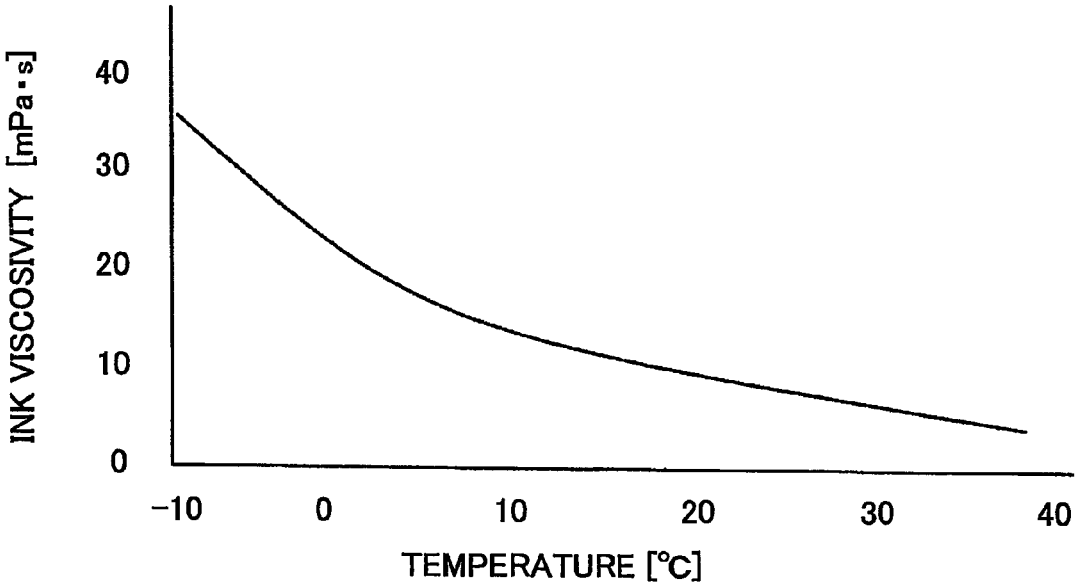
FIG. 40 is a graph showing a relationship between an ink viscosity and a temperature.
Figure 41:
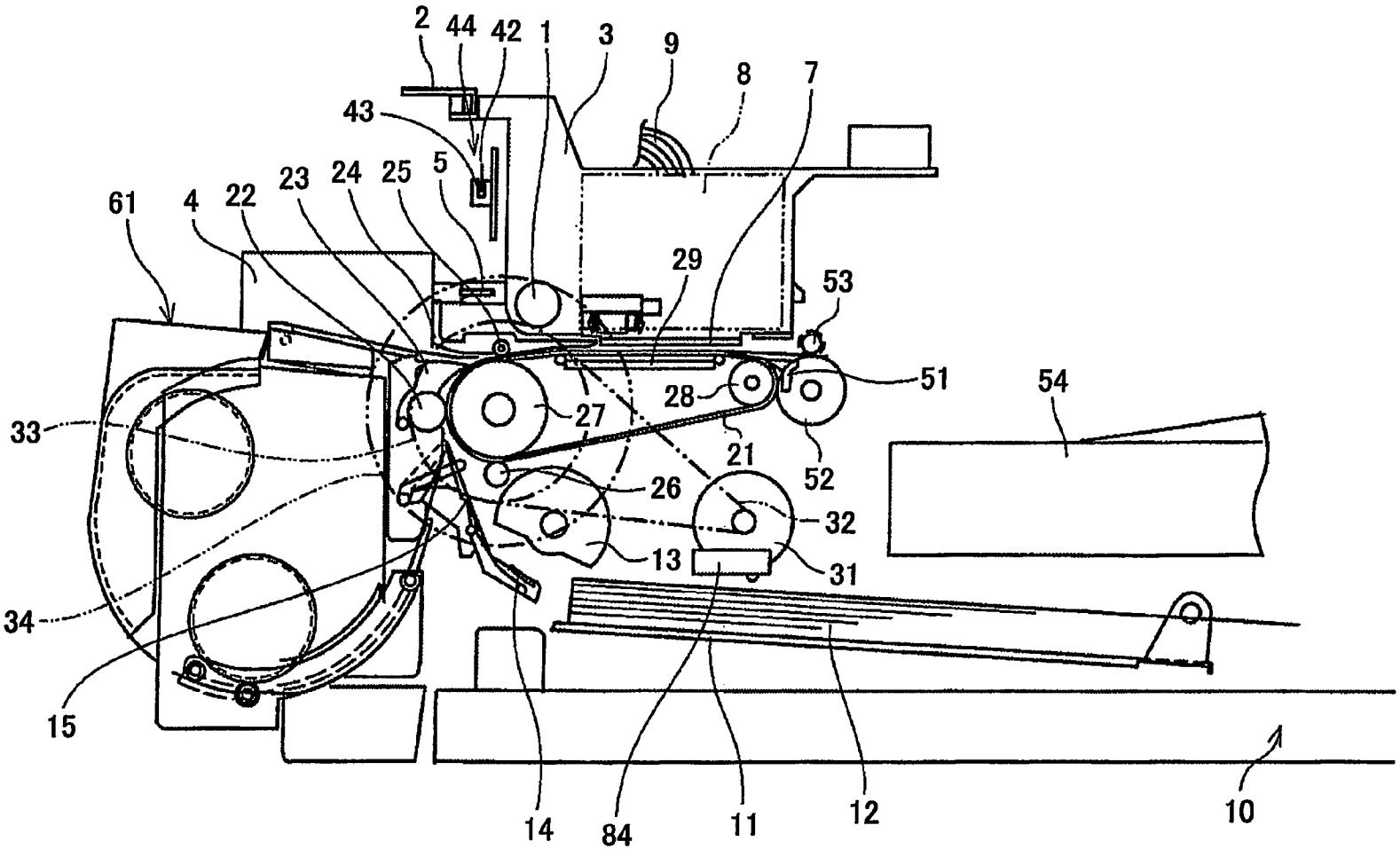
FIG. 41 is an illustrative side view of an image forming apparatus having a temperature sensor.

Additionally, the viscosity of the ink droplet greatly changes depending on a temperature as shown in FIG. 40. Thus, it is preferable to presume the viscosity of the ink droplet by using the environment sensor 118 or providing separately a temperature sensor 84 as shown in FIG. 41.

If a relationship between an amount of ink adhered and a viscosity of the ink droplet having a temperature characteristic is changed into table information, the viscosity of the ink droplet can be determined more accurately, and, thus, both the reduction of an amount of ink adhered on the recording head 7 and the good conveyance performance of the recording paper 12 can be more effectively achieved simultaneously.

As mentioned above, a degree of influence of the electric field given to an ink droplet varies according to the viscosity of the ink droplet. That is, there is a correlation that the mist tends to be produced and easily receives influence of the electric field as the viscosity of the ink droplet is increased. Thus, by adjusting the charges on the surface of the recording medium under the recording head in accordance with the viscosity of the liquid droplets for forming an image on the recording medium, an accuracy of conveyance can be improved, and also a high-quality image can be stably formed without an offset of landing positions of the liquid droplets and a reverse flow of mist toward the recording head due to the electric field under the recording head.

A description will now be given of an image forming apparatus according to an eleventh embodiment of the present invention. In each of the above-mentioned embodiments, in order to achieve both the reduction of an amount of ink adhered and a good conveyance performance, an appropriate control is performed for adjusting an amount of charges on the surface of the recording medium in accordance with a resistance of the recording medium, the result of detection of a relative position of the recording medium with respect to the charges applied to the conveyance belt, a size of the ink droplet discharged from the recording head and a viscosity of the ink droplet discharged from the recording head.

However, there is an interaction between a resistance of the recording medium, the result of detection of a relative position of the recording medium with respect to the charges applied to the conveyance belt, a size of the ink droplet discharged from the recording head and a viscosity of the ink droplet discharged from the recording head. Accordingly, it is preferable to consider not an individual item but all items to optimize the control so as to stably and efficiently form an image without an offset in landing positions of ink droplets and contamination of the recording head due to a reverse flow of ink mist toward the recording head.

Thus, if values obtained from an interaction of at least two items from among items, such as a resistance of the recording medium, a result of detection of a relative position of the recording medium with respect to the charges applied to the conveyance belt, a size of the ink droplet discharged from the recording head and a viscosity of the ink droplet discharged from the recording head, is changed into table information, and the charges of the recording paper under the recording head 7 is adjusted in accordance with a printing condition, an image can be formed stably and more efficiently without an offset in landing positions of ink droplets and contamination of the recording head due to a reverse flow of ink mist toward the recording head.

A description will now be given, with reference to FIG. 42, of an image forming apparatus according to a twelfth embodiment of the present invention. The twelfth embodiment relates to an image forming apparatus that can perform both-side printing.

Figure 42:
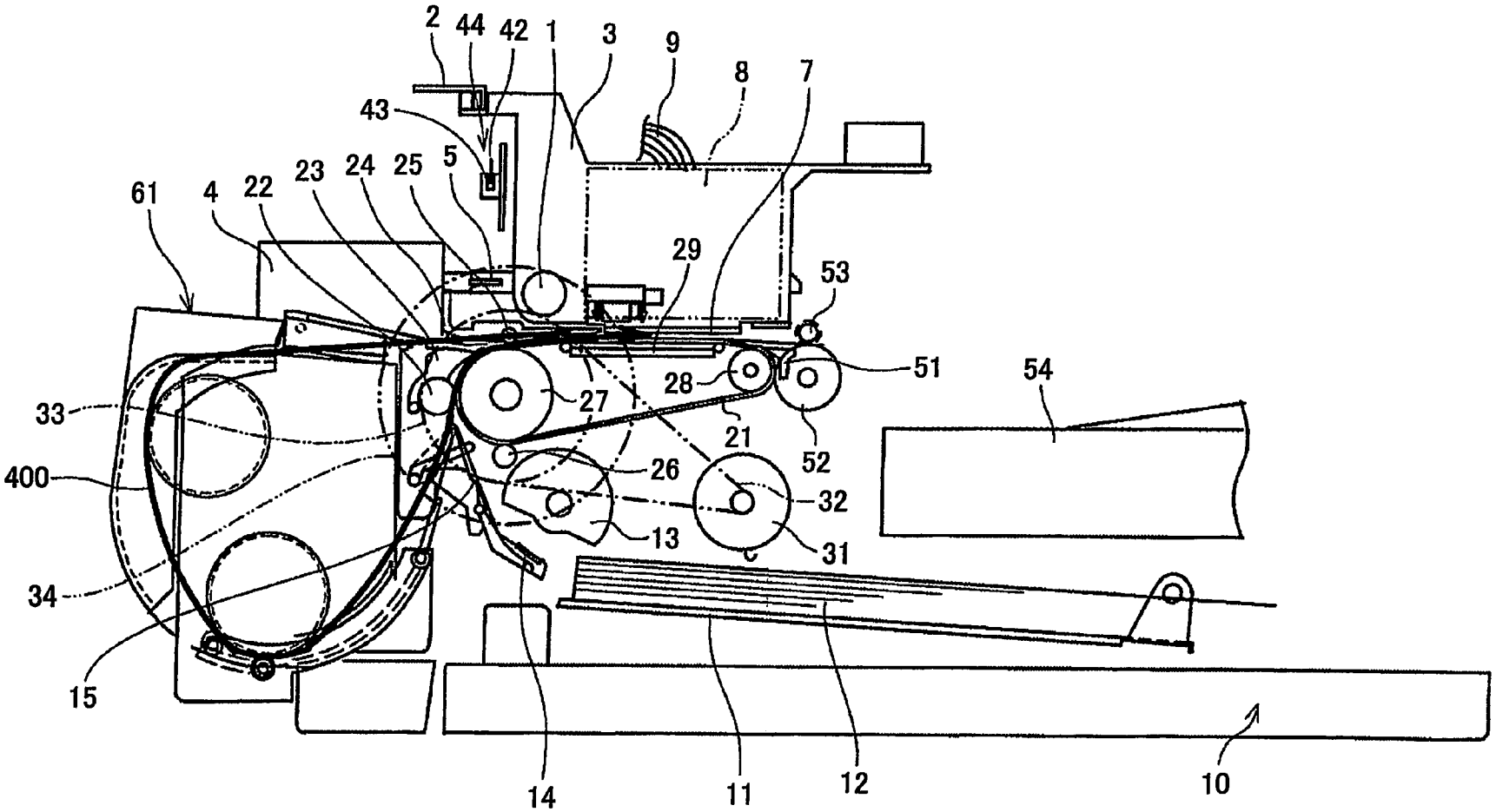
FIG. 42 is an illustrative side view of an image forming apparatus according to a twelfth embodiment of the present invention.

In a case of both-side printing, as shown in FIG. 42, after recording of a first surface (a surface printed first) is finished, the conveyance belt 21 is reversely rotated so as to feed the recording paper 12, which has been recorded, to the both-side paper supply unit 61. Thereby, the recording paper 12 passes through the reverse path 400 and the recording paper 12 is reversed so that the first surface, on which recording has already been performed, is brought into contact with the conveyance belt 21. That is, a second surface, which is not printed yet, is turned to a front surface and the recording paper 12 is conveyed onto the guide member 29. Then, the second surface is printed by liquid droplets discharged from the recording head 7.

Figure 29:
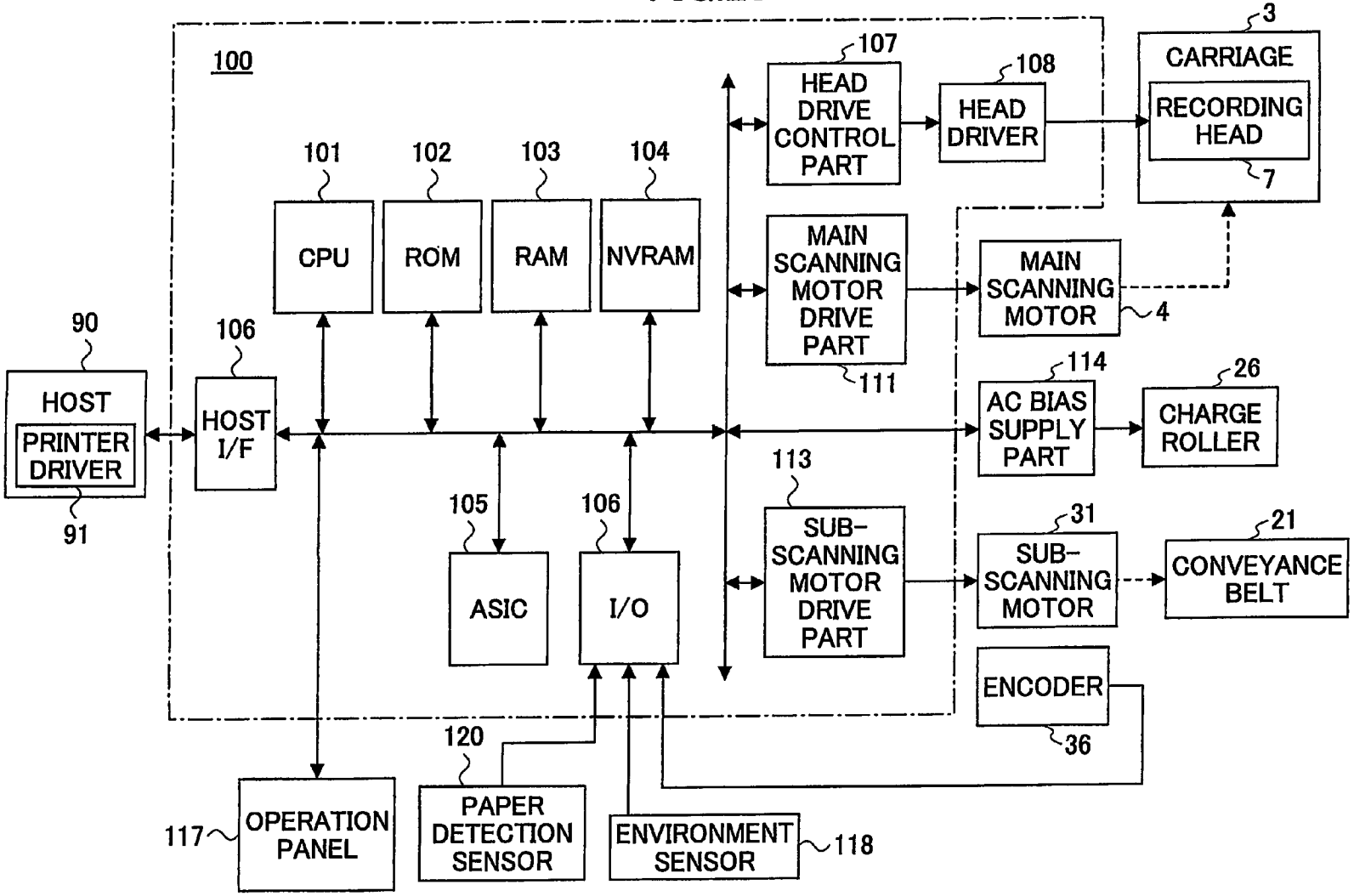
FIG. 29 is a block diagram of the image forming apparatus shown in FIG. 28.
Figure 30:
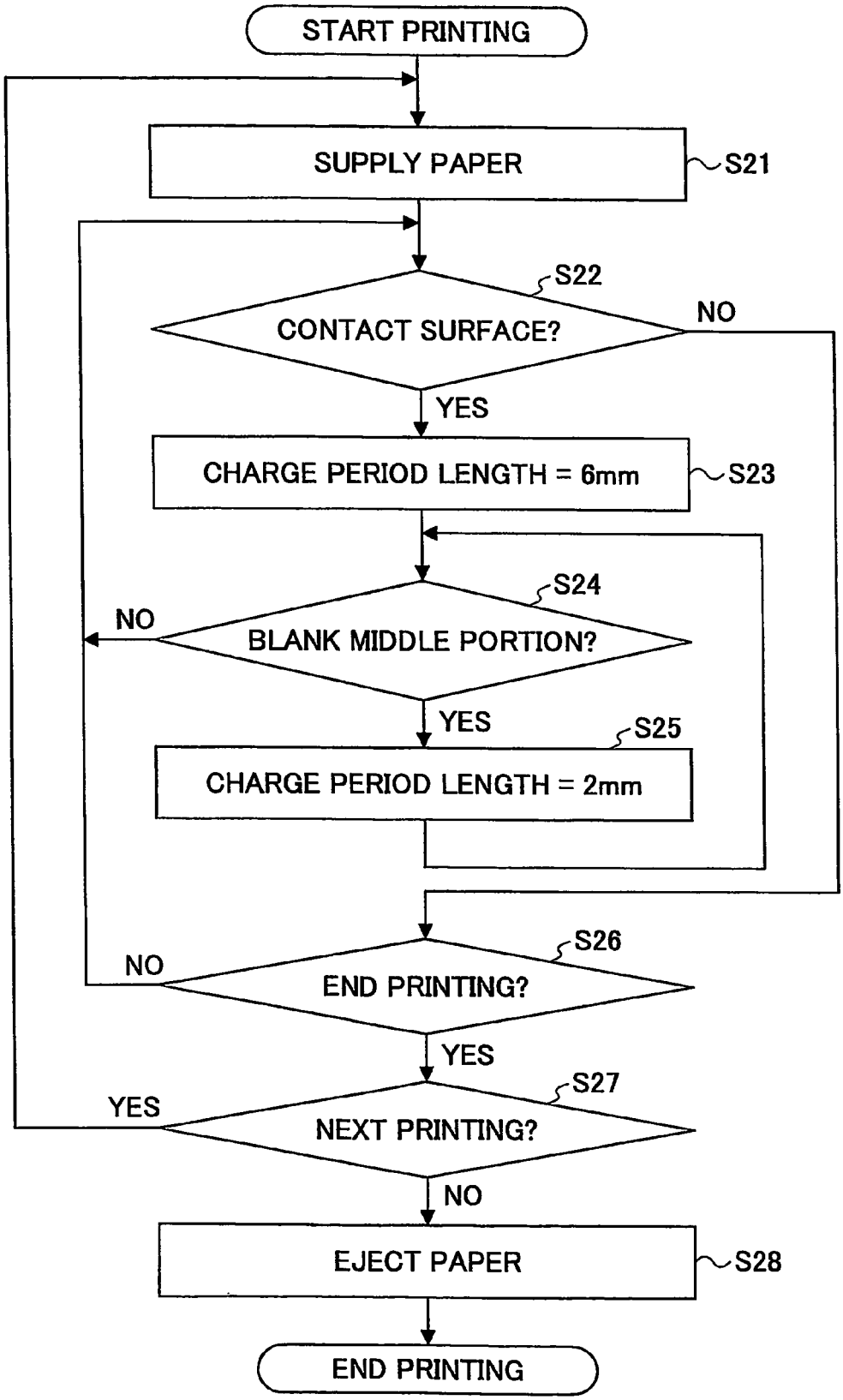
FIG. 30 is a flowchart of a charge control process performed in the image forming apparatus shown in FIG. 29.

It should be noted that other structures are the same as the image forming apparatus according to the above-mentioned fifth embodiment, and the image forming apparatus is provided with the paper detection sensor 120 (refer to FIG. 29).

Figure 43:
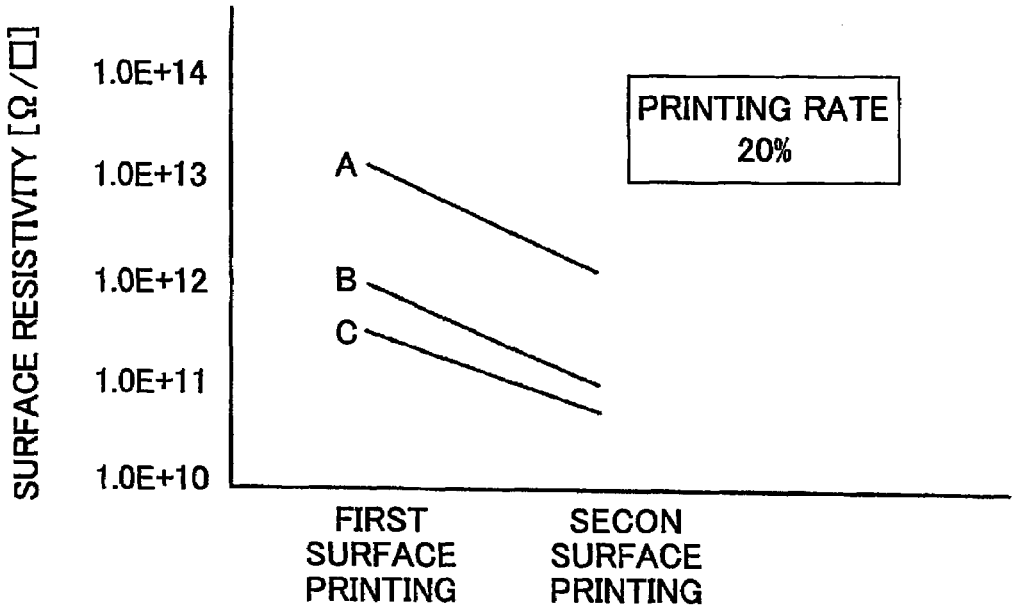
FIG. 43 is a graph showing a result of measurement of surface resistivities of a first surface and a second surface in both-side printing when a print rate is 20% with respect to three kinds of recording papers.
Figure 44:
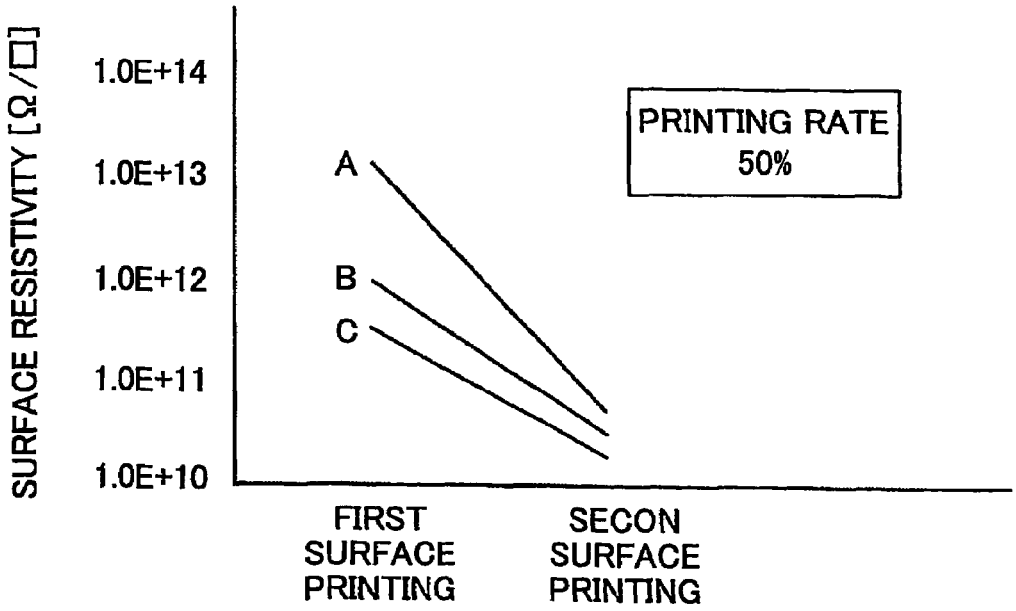
FIG. 44 is a graph showing a result of measurement of surface resistivities of a first surface and a second surface in both-side printing when a print rate is 50% with respect to three kinds of recording papers.

Here, FIG. 43 shows a transition of a surface resistivity from printing of the first surface to the printing of the second surface when printing of CMYK 5%, a total of 20%, is performed on the first surface using three kinds of recording papers having different surface resistivities. As appreciated form FIG. 43, the surface resistivities of the recording papers are decreased, when printing the second surface, due to liquid droplets discharged and adhered onto the first surface.

Figure 45:
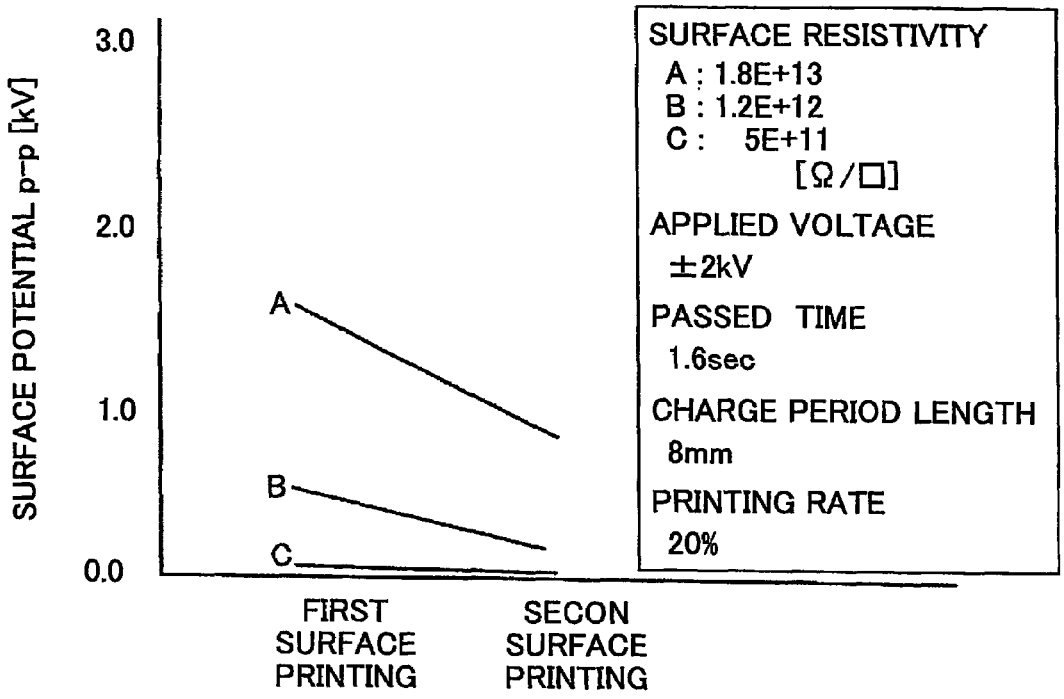
FIG. 45 is a graph showing a result of measurement of changes in a surface potential in both-side printing with respect to three kinds of recording papers.

This is because the charges on the recording paper can be easily moved due to a water component contained in the liquid droplets adhered onto the first surface. The degree of decrease in the surface resistivity of the recording paper is varied by a print rate, that is, an amount of liquid droplets discharged and adhered onto the first surface. If the print rate is 50% of a total of CMYK, the surface resistivity of the second surface is decreased further. For this reason, the surface potential of the second surface of the recording paper 12 under the recording head 7 is lower than the surface potential of the first surface as shown in FIG. 45, thereby suppressing contamination of the head surface (nozzle surface) due to an offset of landing positions of ink droplets or bounce of ink mist.

Figure 46:
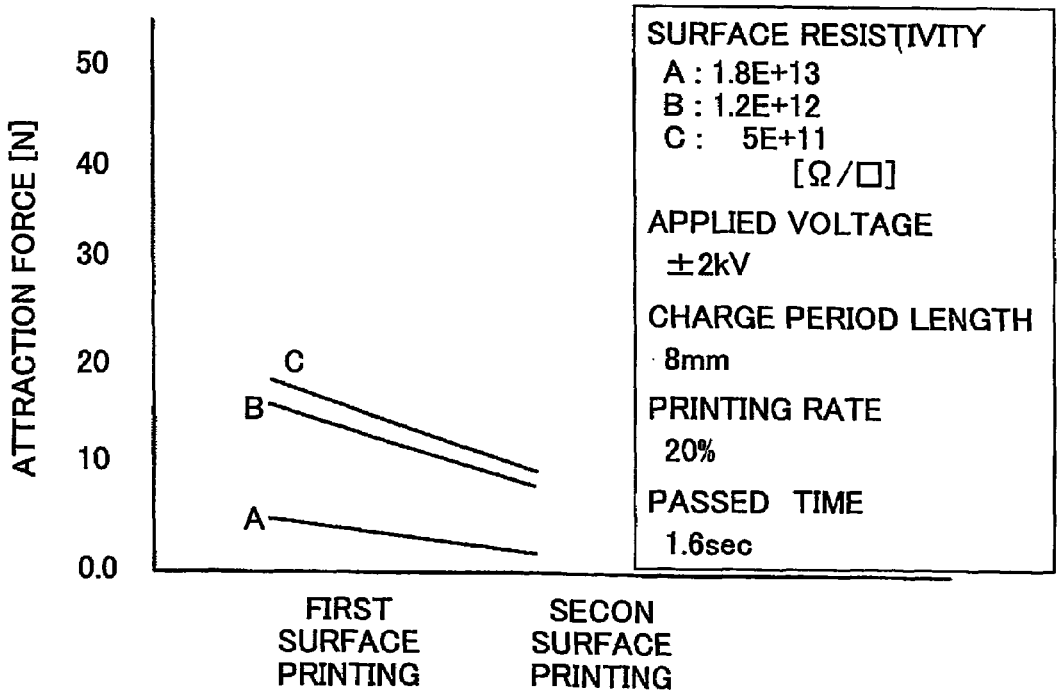
FIG. 46 is a graph showing a result of measurement of changes in an attraction force in both-side printing with respect to three kinds of recording papers.
Figure 47:
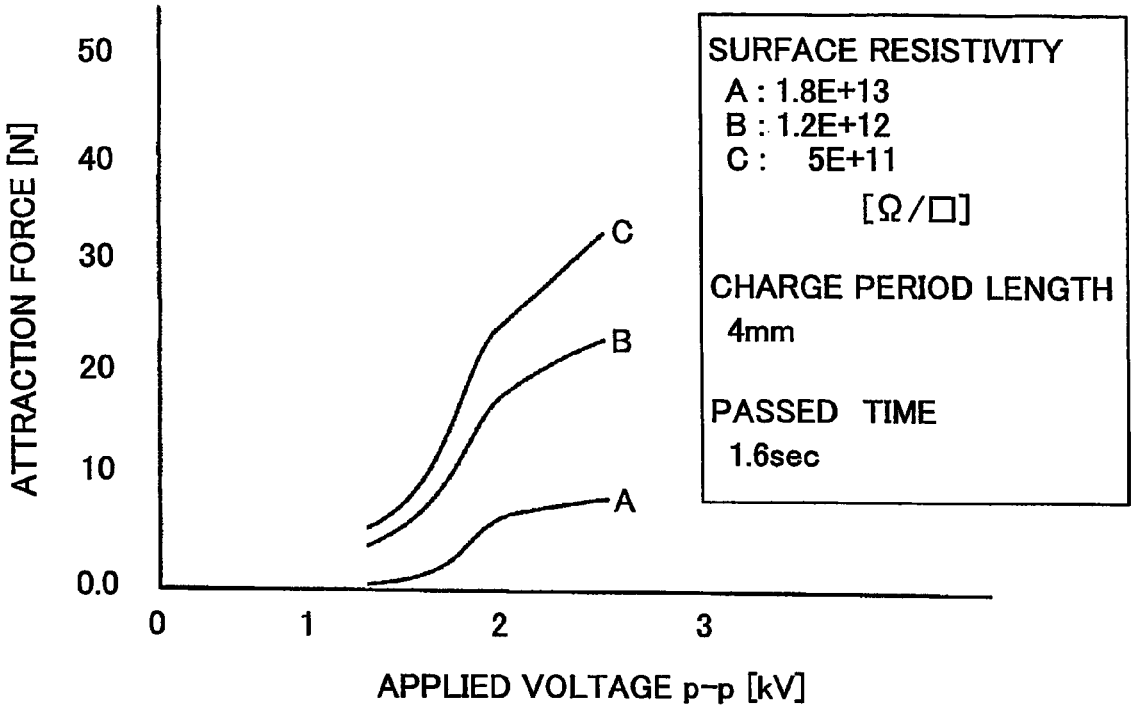
FIG. 47 is a graph showing a relationship between an attraction force and an applied voltage with respect to three kinds of recording papers.

However, when the surface resistivity is decreased, the attraction force to the second surface is decreased as shown in FIG. 46. This is because, if the surface resistivity is decreased, the attraction force exhibits the tendency of the recording paper C shown in FIG. 47 and the peak of the attraction force shifts toward a side where the charge period length is large. Additionally, since the first surface contains a water component, the first surface swells, which generates a force causing opposite ends of the second surface to curl in a direction opposite to the conveyance belt, there is a case in which the ends of the recording paper 12 are lifted from the conveyance belt 21.

Thus, in the present embodiment, when printing both sides, an amount of ink discharged onto the first surface of the recording paper 12 is detected (measured) for each predetermined area of the first surface of the recording paper 12. The detection of the amount of ink can be calculated by the control part 100 by counting a number of droplets discharged from the recording head 7 for each size. Then, using an amount of ink detected for each predetermined area of the first surface of the recording paper 12, a resistance value of the second surface is presumed for each predetermined area of the second surface corresponding to the predetermined area of the first surface. Then, by detecting a leading edge and a trailing edge of the recording paper 12 based on a detection signal of the paper detection sensor 120, a relative position is detected between the charges applied to the conveyance belt 21 and the predetermined area having the presumed resistance value in the recording paper 12.

By controlling the charge period length in accordance with the presumed resistance value of each predetermined area of the second surface of the recording paper 12 so that the surface potential of the second surface of the recording paper 12 under the recording head 7 becomes an optimum value, both the reduction of the surface potential and the attraction force under the recording head 7 can be achieved simultaneously. That is, by adjusting the charges on the surface of the recording medium under the recording head based on the resistance value of the recording medium and whether the image forming surface is the first surface which is printed first or the second surface which is printed next, the recording medium can be attracted by the conveyance belt so as to improve an accuracy of conveyance, and a high-quality image can be stably formed without an offset of landing positions of liquid droplets and contamination due to a reverse flow of mist toward the recording head due to an electric field under the recording head.

In this case, the resistance value of the second surface can be presumed more accurately by presuming the resistance value of the second surface based on an amount of liquid adhered onto the first surface. Further, by presuming the resistance value for each predetermined area of the second surface of the recording medium based on an amount of liquid adhered onto the predetermined area of the first surface of the recording medium, the resistance value of the second surface can be presumed more accurately.

The present invention is not limited to the specifically disclosed embodiments, and variations and modifications may be made without departing from the scope of the present invention.

The invention claimed is:

1. An image forming apparatus comprising:

a conveyance belt that conveys a recording medium by attracting the recording medium by an electrostatic force generated by positive and negative electric charges applied thereto;

a charger that applies the positive and negative electric charges alternately to said conveyance belt;

a recording head that discharges droplets of a recording liquid toward the recording medium being conveyed by said conveyance belt;

a control part configured to adjust an amount of electric charges induced on a surface of the recording medium by the positive and negative electric charges applied to said conveyance belt; and a surface resistance measurement part configured to detect a surface resistance value of the recording medium;

wherein said control part adjusts the amount of the electric charges on the surface of the recording medium in accordance with the surface resistance detected by said surface resistance measurement part.

2. The image forming apparatus as claimed in claim 1, wherein said control part adjusts the amount of the electric charges on the surface of the recording medium in accordance with a result of detection of a volume resistance of the recording medium.

3. The image forming apparatus as claimed in claim 1, wherein said control pad adjusts the amount of the electric charges on the surface of the recording medium in accordance with a result of detection of environment temperature and humidity.

4. The image forming apparatus as claimed in claim 1, wherein said control part adjusts the amount of the electric charges on the surface of the recording medium in accordance with externally given information regarding the resistance value of the recording medium.

5. The image forming apparatus as claimed in claim 1, wherein said control part adjusts the amount of the electric charges on the surface of the recording medium by controlling a charge period length of positive and negative charges applied by said charger to said conveyance belt.

6. The image forming apparatus as claimed in claim 1, wherein said control part adjusts the amount of the electric charges on the surface of the recording medium by controlling an alternating voltage applied to said charger to apply positive and negative charges to said conveyance belt.

7. The image funning apparatus as claimed in claim 1, wherein said control part adjusts the amount of the electric charges on the surface of the recording medium by controlling a timing of applying electric charges onto said conveyance belt so as to switch existence/nonexistence of charges on the surface of the recording medium.

8. The image forming apparatus as claimed in claim 1, wherein said control part adjusts the amount of the electric charges on the surface of the recording medium by controlling at least one of a conveyance speed and a stop time of said conveyance belt so as to change a time period from a time when the charges are applied to said conveyance belt until a time when the charges on said conveyance belt reach the recording position.

9. The image forming apparatus of claim 1, wherein said control part adjusts the amount of the electric charges oil the surface of the recording medium so that a surface potential at the recording position is equal to or smaller than 500 Vp-p.

10. The image forming apparatus of claim 1, wherein said control part adjusts the amount of the electric charges on the surface of the recording medium so that a volume potential at the recording position is equal to or smaller than 500 Vp-p.

11. An image forming apparatus comprising:

a conveyance belt;

a charger configured to apply positive and negative electric charges alternately to said conveyance belt;

a control part configured to adjust an amount of electric charges induced on a surface of a recording medium by the positive and negative electric charges applied to said conveyance belt; and a surface resistance measurement part configured to detect a surface resistance value of the recording medium;

wherein said control pan is configured to neutralize an amount of electric charges on the surface of the recording medium by controlling the charger, and wherein said control part adjusts the amount of the electric charges on the surface of the recording medium in accordance with a resistance value of the recording medium, and adjusts the amount of the electric charges on the surface of the recording medium in accordance with the surface resistance value detected by said surface resistance measurement part.

12. The image forming apparatus of claim 11, wherein said control part adjusts the amount of the electric charges on the surface of the recording medium so that a surface potential at the recording position is equal to or smaller than 500 Vp-p.

13. The image forming apparatus of claim 11, wherein said control part adjusts the amount of the electric charges on the surface of the recording medium so that a volume potential at the recording position is equal to or smaller than 500 Vp-p.

14. A method for conveying a recording medium comprising:

adjusting an amount of positive and negative electric charges to be applied in a conveyance belt in accordance with a resistance of a recording medium;

applying the positive and negative electric charges alternately to the conveyance belt with a charger;

controlling the charger to neutralize an amount of electric charges on the surface of the recording medium;

feeding the recording medium towards the conveyance belt so that the electric charges attract the recording medium to the conveyance belt; and rotating the conveyance belt, wherein the amount of positive and negative electric charges is adjusted in accordance with a surface resistance detected by a surface resistance measurement part.

15. The method of claim 14, wherein the amount of positive and negative charges is adjusted so that a surface potential of the recording medium at a recording position is equal to or smaller than 500 Vp-p.

16. The method of claim 14, wherein the amount of positive and negative charges is adjusted so that a volume potential of the recording medium at a recording position is equal to or smaller than 500 Vp-p.

* * * * *